US011859952B1

(12) United States Patent
Eichenblatt

(10) Patent No.: US 11,859,952 B1
(45) Date of Patent: Jan. 2, 2024

(54) ARMORED PLATE ASSEMBLY

(71) Applicant: Ambitec Inc., Miami, FL (US)

(72) Inventor: Eliyahu Eichenblatt, Miami, FL (US)

(73) Assignee: Ambitec Inc., Miami, FL (US)

( * ) Notice: Subject to any disclaimer, the term of this patent is extended or adjusted under 35 U.S.C. 154(b) by 93 days.

(21) Appl. No.: 17/536,645

(22) Filed: Nov. 29, 2021

Related U.S. Application Data

(60) Provisional application No. 63/172,300, filed on Apr. 8, 2021.

(51) Int. Cl.
*F41H 5/02* (2006.01)
*F41H 5/04* (2006.01)

(52) U.S. Cl.
CPC ..... *F41H 5/023* (2013.01); *F41H 5/0421* (2013.01); *F41H 5/0428* (2013.01)

(58) Field of Classification Search
CPC ..... F41H 5/02; F41H 5/023; F41H 5/0421; F41H 5/0428
See application file for complete search history.

(56) References Cited

U.S. PATENT DOCUMENTS 6,389,594 B1 * 5/2002 Yavin ..... F41H 5/0428 2/2.5
6,895,851 B1 * 5/2005 Adams ..... F41H 5/0442 428/548
6,899,009 B2 * 5/2005 Christiansen ..... E06B 9/00 89/36.02
7,930,966 B1 4/2011 Bhatnagar et al.
8,281,550 B1 * 10/2012 Bolton ..... C09K 21/10 52/204.5
9,291,440 B2 * 3/2016 Ardiff ..... F42D 5/05
2002/0094406 A1 * 7/2002 Cohen ..... F41H 5/0421 428/626
2004/0118271 A1 * 6/2004 Puckett ..... F41H 5/0428 89/36.02
2010/0170386 A1 * 7/2010 Bhatnagar ..... F41H 5/0428 89/914
2012/0186432 A1 * 7/2012 St. Claire ..... F41H 5/023 89/914
2013/0263727 A1 * 10/2013 O'Masta ..... B32B 3/18 89/36.02
2013/0284003 A1 * 10/2013 Dodworth ..... F41H 5/0464 428/116
2014/0230638 A1 * 8/2014 Waldrop ..... F41H 5/0471 89/36.02
2014/0260933 A1 * 9/2014 Ardiff ..... F42D 5/05 89/36.02
2015/0211830 A1 * 7/2015 Xu ..... F41H 5/02 89/36.02

(Continued)

FOREIGN PATENT DOCUMENTS

CN 111220027 6/2020
WO WO 2015/179013 11/2015

*Primary Examiner* — Joshua E Freeman
(74) *Attorney, Agent, or Firm* — Hartman & Citrin LLC

(57) ABSTRACT

An armored plate assembly can include a base plate, a gap layer, a containment structure around edges of the gap layer, and a coating that can be applied to an assembly of the base plate, the gap layer, and the containment structure. In some embodiments, the base plate can be formed from steel, the gap layer can be formed from natural cork, the containment structure can be formed from a polymer, and the coating can be formed from polyurea.

20 Claims, 22 Drawing Sheets

(56) References Cited

U.S. PATENT DOCUMENTS

| | | | | |
|---|---|---|---|---|
| 2015/0268007 | A1* | 9/2015 | Bergman | F41H 5/0421 89/36.02 |
| 2016/0102949 | A1* | 4/2016 | Smith | F41H 5/0492 89/36.02 |
| 2016/0169632 | A1* | 6/2016 | Holtz | F41H 5/0428 89/36.02 |
| 2017/0254625 | A1* | 9/2017 | Spransy | B32B 37/142 |
| 2018/0010890 | A1* | 1/2018 | Waldrop | F41H 5/0492 |
| 2019/0003806 | A1* | 1/2019 | Gajdzinski | B32B 15/14 |
| 2019/0056203 | A1* | 2/2019 | Rodrigues | B32B 7/12 |
| 2019/0120598 | A1* | 4/2019 | Bourque | B32B 5/26 |
| 2019/0120599 | A1 | 4/2019 | Roland et al. | |
| 2020/0200510 | A1* | 6/2020 | Bessey | B32B 5/06 |
| 2020/0363163 | A1* | 11/2020 | Lyons | F41H 1/00 |
| 2021/0146637 | A1* | 5/2021 | Jonassen | B32B 9/005 |
| 2021/0372740 | A1* | 12/2021 | Lyons | F41H 5/0478 |

* cited by examiner

ARMORED PLATE ASSEMBLY

CROSS-REFERENCE TO RELATED APPLICATIONS

This application is a nonprovisional of and claims the benefit of U.S. Patent Application No. 63/172,300, entitled "Armored Plate Assembly," filed Apr. 8, 2021, which is incorporated herein by reference in its entirety.

TECHNICAL FIELD

The present disclosure relates generally to firearms and weapons technologies. More particularly, the present disclosure relates to an armored plate assembly that can be incorporated into body armor or used in other applications.

BACKGROUND

Unless otherwise indicated herein, all disclosures in the background are not prior art to the claims in this application and are not admitted to be prior art by inclusion in this section.

Body armor has been used for many years as protection against physical threats from sharp and fast-moving objects. In fact, for thousands of years iron and/or steel have been used for body armor. In recent years, new technologies and/or materials have been developed to protect against physical threats. Such technologies and/or materials include, for example, KEVLAR® brand materials and/or other aramids, ultra-high-molecular-weight polyethylene ("UHMWPE" or "UHMW") and/or other polymers, various ceramics, and/or other materials. Still, ballistic-rated steel may be used, for example, in body armor, tanks, armored vehicles, and/or other devices and/or structures due to the properties and strength of steel (e.g., the multiple-hit capabilities of steel, the ability to protect against large projectiles, the relatively low cost of steel relative to some other materials, etc.).

In particular, while some embodiments of armor made from ceramics and/or some other materials may be able to stop a projectile, these embodiments of armor may be destroyed on impact, thereby requiring replacement after one use. Similarly, while some embodiments of armor made from UHMWPE may be lightweight and may be able to stop some projectiles (e.g., bullets), some embodiments of armor made from UHMWPE may be unable to protect against high velocity and/or large caliber projectiles (e.g., bullets fired from firearms chambered in .223 Remington, 5.56 NATO, 7.62 NATO, and/or some other calibers). Thus, steel embodiments of armor (e.g., body armor) may still be the preferred choice for some applications due to the ability of steel armor to protect against multiple projectiles and/or some projectiles (e.g., certain calibers, certain mass, and/or certain velocities).

Similarly, some embodiments of armor that incorporate KEVLAR® brand materials and/or ballistic aramids may be capable of protecting against some projectiles (e.g., projectiles fired from firearms chambered in .22 long rifle ("22 LR"), .380 automatic Colt pistol ("380 ACP"), other calibers, etc.), but may be ineffective against relatively larger and/or higher velocity projectiles (e.g., bullets fired from firearms chambered in .308 Winchester, 7.62 NATO, etc.). Furthermore, armor incorporating KEVLAR® brand materials and/or ballistic aramids may protect against some types of projectiles, but may or may not protect against shrapnel fragmentation and/or projectile spalling (also referred to herein as "spall"). Thus, for some armor types, ceramics and/or steel materials may be preferable to some other modern materials. In some embodiments, steel also may be preferred due to the durability, relatively low cost, and stopping power provided by steel.

Steel, however, can have some disadvantages relative to some other materials used for body armor. In particular, the types and sizes of steel structures commonly used for body armor can be heavier than many ceramics used for body armor, as well as being heavier than UHMWPE and aramids. Also, steel may not absorb an incoming projectile. Rather, projectiles engaging steel (e.g., a steel plate in body armor) may shatter or spall, and the spalling (the fragments resulting from this fragmentation) may injure the wearer of the body armor and/or bystanders in some embodiments.

One approach that has been adopted to try to reduce spalling in armor applications is the application of a coating or sleeve to the armor (e.g., to steel plates). The sleeve or coating can be used to contain the spalling, but the amount needed for this purpose is high and adds weight to the armor. In particular, some applications of coatings or sleeves to body armor include the use of an approximately-one-inch-thick coating of polyurea and/or up to five layers of a KEVLAR® brand material. These coatings and/or sleeves can add substantial weight, bulk, and/or cost to the resulting armor (relative to a bare steel plate).

When a high-energy projectile (e.g., a bullet) strikes a steel personal armor system, a part of the projectile can evaporate, and other parts of the projectiles can become small particles that can travel mostly parallel to the surface of the steel plate or other structure of the steel personal armor system. These particles, herein referred to as "spall" can travel at high velocity. Spall can cause injury to people, including not only the wearer of the armor system, but also those near the person being protected by the armor system; hence the need to "contain" spall.

Ideally, an armor system shot with a projectile fired from a large caliber firearm such as, for example, a 223 Remington caliber firearm, a .30-06 Springfield caliber firearm, a .308 Winchester caliber firearm, a 7.62X51 (7.62 NATO) caliber firearm, and/or projectiles from other caliber firearms, or the like, should be capable of stopping the projectile itself, as well as containing all projectile fragments/spall. At least, it would be positive if the projectile fragments that escape the armor system do so only at low velocity as this would reduce the ability of the projectile fragments to inflict injury on the wearer of the armor system and/or bystanders.

SUMMARY

The present disclosure is directed to an armored plate assembly. Embodiments of the armored plate assembly illustrated and described herein can be configured to stop a projectile and contain projectile fragmentation/spall within the armored plate assembly. Some embodiments of the armored plate assembly illustrated and described herein can include a first plate that can operate as a base plate. In some embodiments, the base plate can be formed from steel or other metal alloys, metals, and/or other materials such as ceramics or composites. The armored plate assembly further can include a secondary plate. The secondary plate can be formed, in some embodiments, by a layer of KEVLAR® brand materials and/or other materials, such as glass, aramid or carbon fiber weaves or strands, polymers such as polyurea, fiber-reinforced composites or metals, combinations thereof, or the like. The secondary plate can be assembled to the base plate while leaving a gap layer between the base plate and the secondary plate. In some embodiments, the gap layer can correspond to an air chamber. In some other embodiments, the gap layer can correspond to a layer of another material such as, for example, wood, cork, polymers (e.g., acrylics, epoxies, etc.), foams (e.g., polymer foams, ceramic foams, metal foams such as aluminum foams, etc.) and/or other materials.

In some other embodiments, the armored plate assembly can omit the secondary plate and/or can substitute materials typically used for the gap layer for the materials of the secondary plate. In particular, the armored plate assembly can include, in some embodiments, a first plate that can operate as a base plate, wherein the base plate can be formed from steel or other metal alloys, metals, and/or other materials such as ceramics or composites. The armored plate assembly further can include a gap layer that can be formed from a material such as, for example, wood, cork, polymers (e.g., acrylics, epoxies, etc.), foams (e.g., polymer foams, ceramic foams, metal foams such as aluminum foams, etc.) and/or other materials.

The assembly of the two or three layers, depending on the embodiment, can be coated with a coating such as, for example, polyurea; wrapped in a metal sheet; cast in a resin such as epoxy; or the like. In various embodiments, the assembly of the two or three layers is coated with a substantially continuous coating of polyurea. In some embodiments, the polyurea can be applied to the assembly of the two or three layers such that the polyurea coating has a non-uniform or substantially uniform thickness. The thickness of the polyurea coating in various embodiments of the concepts and technologies disclosed herein can be in a range of thicknesses of from about one sixteenth of an inch (~1.5 mm) to about one quarter of an inch (~6.5 mm), which can correspond to a substantial reduction in thickness relative to other polyurea-coated armor structures which can sometimes include up to an inch-thick coating of polyurea. Thus, embodiments of the concepts and technologies disclosed herein can provide an effective armored plate assembly in a smaller, thinner, and lighter form factor relative to other types of armored plate assemblies.

In various embodiments of the concepts and technologies disclosed herein, the thickness of the polyurea (from within the ranges set forth above) can be determined based on variables such as cost, expected threats and/or protection levels, size constraints, weight, or the like; while in some other embodiments, the thickness of the polyurea can result as a function of how much polyurea may be applied to provide a continuous coating over the entirety of the assembly formed from the two or three layers as described herein. It should be understood that this example is illustrative, and therefore should not be construed as being limiting in any way.

Thus, one embodiment of the armored plate assembly illustrated and described herein can include an armor plate subassembly including a) a single steel plate that can function as the base plate; b) a layer of cork that can function as the gap layer; and c) a layer of KEVLAR® brand material that can function as the secondary plate. A coating of polyurea can be applied to the armor plate subassembly. In various embodiments, the outside of the armor plate subassembly can be coated with polyurea. This combination of materials can be configured to provide protection from direct impact (e.g., direct engagement from projectiles) as well as spalling as described herein above. It should be understood that this example is illustrative, and therefore should not be construed as being limiting in any way.

In another embodiment of the armored plate assembly illustrated and described herein, the armored plate assembly can include an armor plate subassembly including a) a single steel plate that can function as the base plate; and b) a layer of cork that can function as the gap layer. A coating of polyurea can be applied to the armor plate subassembly. In various embodiments, the entirety of the outside of the armor plate subassembly can be coated with polyurea. This combination of materials can be configured to provide protection from direct impact (e.g., direct engagement from projectiles) as well as spalling as described herein. In some embodiments of the concepts and technologies disclosed herein, a base plate (e.g., a steel plate) can be configured to stop a projectile such as a bullet, and a gap layer (e.g., a layer of natural cork) can be configured to stop most spall. It should be understood that this example embodiment is illustrative, and therefore should not be construed as being limiting in any way.

According to some contemplated embodiments of the concepts and technologies disclosed herein, the base plate can be made out of steel (e.g., an abrasion resistant steel treated to 500 or 600 hardness) or other materials. The gap layer can be formed from a material such as a polymer, steel wool, or other materials such as, for example, natural cork. In some embodiments, for example, the gap layer can be formed from a rubberized heat resistant cork, a polyethylene foam (packing foam sheets), natural cork, and/or other materials as alternatives. In some embodiments, an armored plate assembly formed with these components can prevent penetration of bullets through the base plate, and can result in minimal front-facing spall escaping in this configuration. In some embodiments, the edges may contain all spall and prevent penetration of the spall from within the armored plate to outside of the armored plate assembly.

In some other embodiments, an armored plate assembly can include an armor plate subassembly that can include a ballistic steel plate; a natural cork gap layer; and one or more containment layers or structures that can be located around the edges of the base plate and secondary plate (e.g., a gasket formed from natural rubber (e.g., 60 durometer, 70 durometer, or other types of rubber) and/or other materials). The armor plate subassembly can be coated with a coating of polyurea to form the armored plate assembly.

Another embodiment of the armored plate assembly includes a rubber gasket that can serve as the containment layer. In yet other embodiments, the containment layer can be reinforced by adding metal clamps between the containment layer and the polyurea coating to reinforce the edges and attempt to eliminate or further reduce edge penetration of spall. It should be understood that this example is illustrative, and therefore should not be construed as being limiting in any way.

In another contemplated embodiment of the armored plate assembly, the armored plate assembly can include a metal bracket that can be designed to hold the containment layer or structures onto the steel plate and/or to distribute a lifting force over a larger area, thus engaging more of the polyurea to prevent failure of the polyurea coating. This embodiment can address instances in which an expanding pressure wave generated within the armor plate subassembly during engagement by a projectile can result in the lifting of the containment layer or structure off the base plate and/or secondary plate, which otherwise may result in striking of the polyurea edge, potentially resulting in failure of the polyurea coating at the edges. It should be understood that this example is illustrative, and therefore should not be construed as being limiting in any way.

DETAILED DESCRIPTION

Figure 1A:
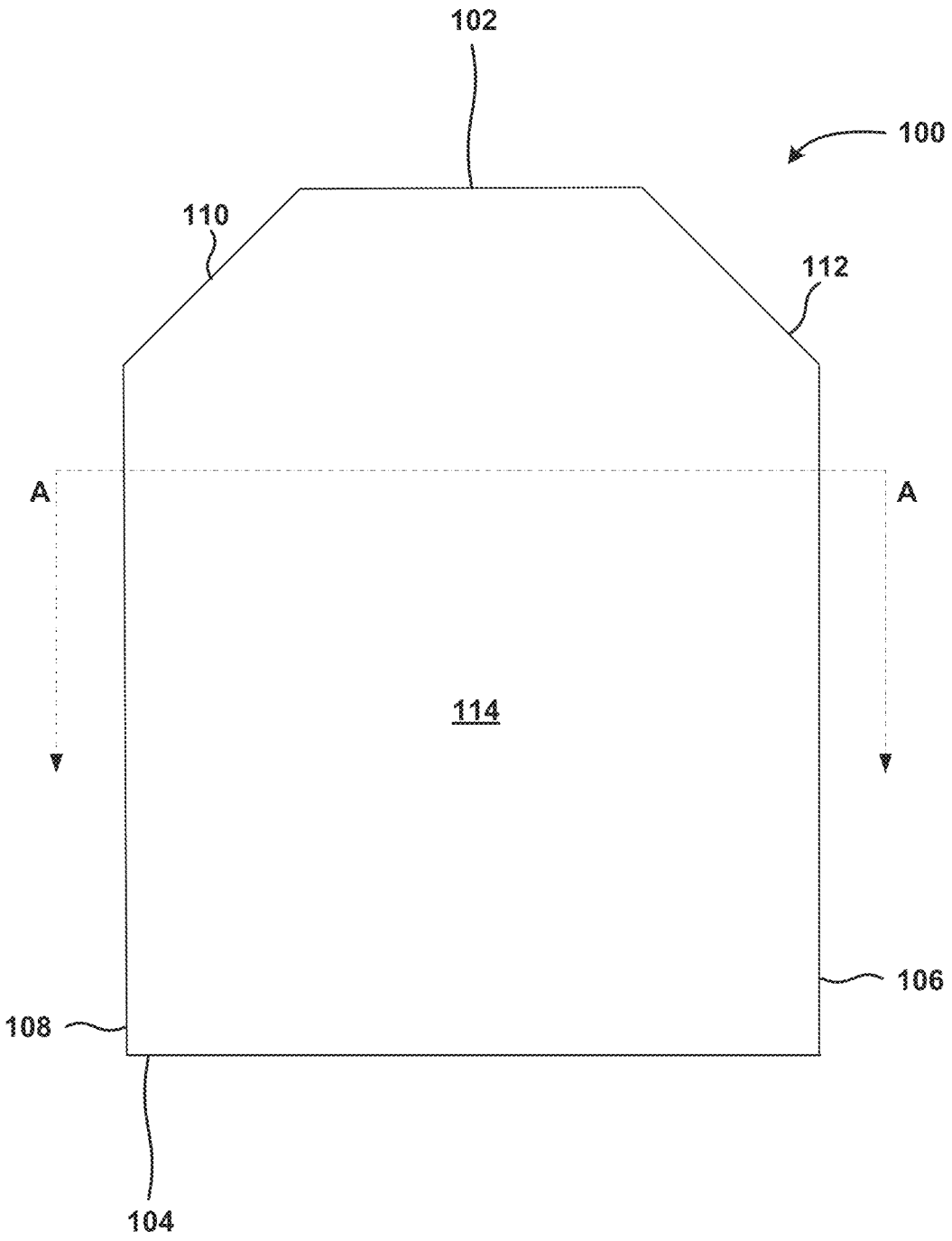
FIG. 1A is a line drawing illustrating an armored plate assembly as viewed from a first side sometimes referred to herein as the front side and/or as a strike face, according to an illustrative embodiment of the concepts and technologies disclosed herein.

In the following detailed description, references are made to the accompanying drawings that form a part hereof and that show, by way of illustration, specific embodiments or examples. It must be understood that the disclosed embodiments are merely illustrative of the concepts and technologies disclosed herein. The concepts and technologies disclosed herein may be embodied in various and alternative forms, and/or in various combinations of the embodiments disclosed herein. The word "illustrative," as used in the specification, is used expansively to refer to embodiments that serve as an illustration, specimen, model, sample, or pattern.

Additionally, it should be understood that the drawings are not necessarily to scale, and that some features may be exaggerated or minimized to show details of particular components. In other instances, well-known components, systems, materials or methods have not been described in detail in order to avoid obscuring the present disclosure. Therefore, specific structural and functional details disclosed herein are not to be interpreted as limiting, but merely as a basis for the claims and as a representative basis for teaching one skilled in the art to variously employ the present disclosure. Referring now to the drawings, in which like numerals represent like elements throughout the several figures, aspects of an armored plate assembly will be described.

Figure 1B:
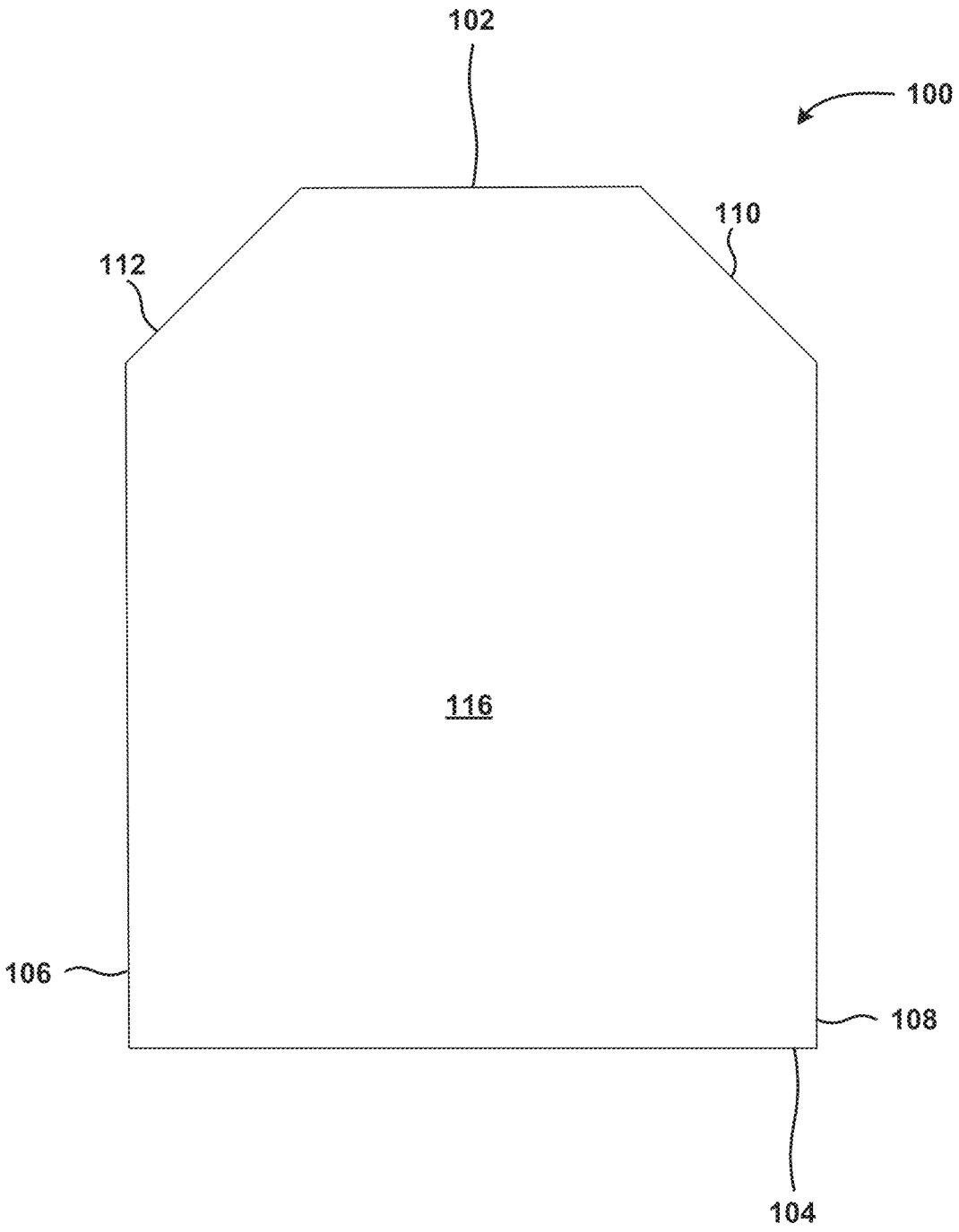
FIG. 1B is a line drawing illustrating an armored plate assembly as viewed from a second side sometimes referred to herein as the back side and/or as a body face, according to an illustrative embodiment of the concepts and technologies disclosed herein.

Referring first to FIGS. 1A-1B, an armored plate assembly 100 is shown, according to an illustrative embodiment of the concepts and technologies disclosed herein. It should be understood that the shape of the armored plate assembly 100 as illustrated in FIGS. 1A-1B is merely illustrative of one contemplated embodiment, as other shapes, configurations, dimensions (absolute and/or relative), and/or sizes (absolute and/or relative) are possible and are contemplated. As such, it should be understood that this example polygonal shape is illustrative, and therefore should not be construed as being limiting in any way.

The armored plate assembly 100 is illustrated as a polygonal structure having a top edge 102, a bottom edge 104, a first side edge 106, a second side edge 108, a first angled edge 110, and a second angled edge 112. It should be understood that the polygonal shape illustrated in FIGS. 1A-1B is purely illustrative, as other polygonal and/or non-polygonal shapes having any number of edges are possible and are contemplated, as are other shapes such as circular, elliptical, irregular, curved, etc. As such, the illustrated embodiment is illustrative and should not be construed as being limiting in any way.

The armored plate assembly 100 also can have a first surface 114 (illustrated as the surface facing the viewing plane in FIG. 1A), which can be referred to herein as a "front side," "front surface," or "strike face." The armored plate assembly 100 also can have a second surface 116, which can be on the opposite side of the armored plate assembly 100 relative to the first surface 114, and which can be referred to herein as a "back side," "back surface," or "body face." The second surface 116 is not visible in FIG. 1A, but is visible as the surface facing the viewing plane in FIG. 1B. A line A-A is also illustrated in FIG. 1A, and a cross-sectional view of the armored plate assembly 100 viewed along line A-A will be illustrated and described in more detail below with reference to FIG. 3. It should be understood that the illustrated embodiment of the armored plate assembly 100 shown in FIGS. 1A-1B is illustrative and should not be construed as being limiting in any way.

Figure 2:
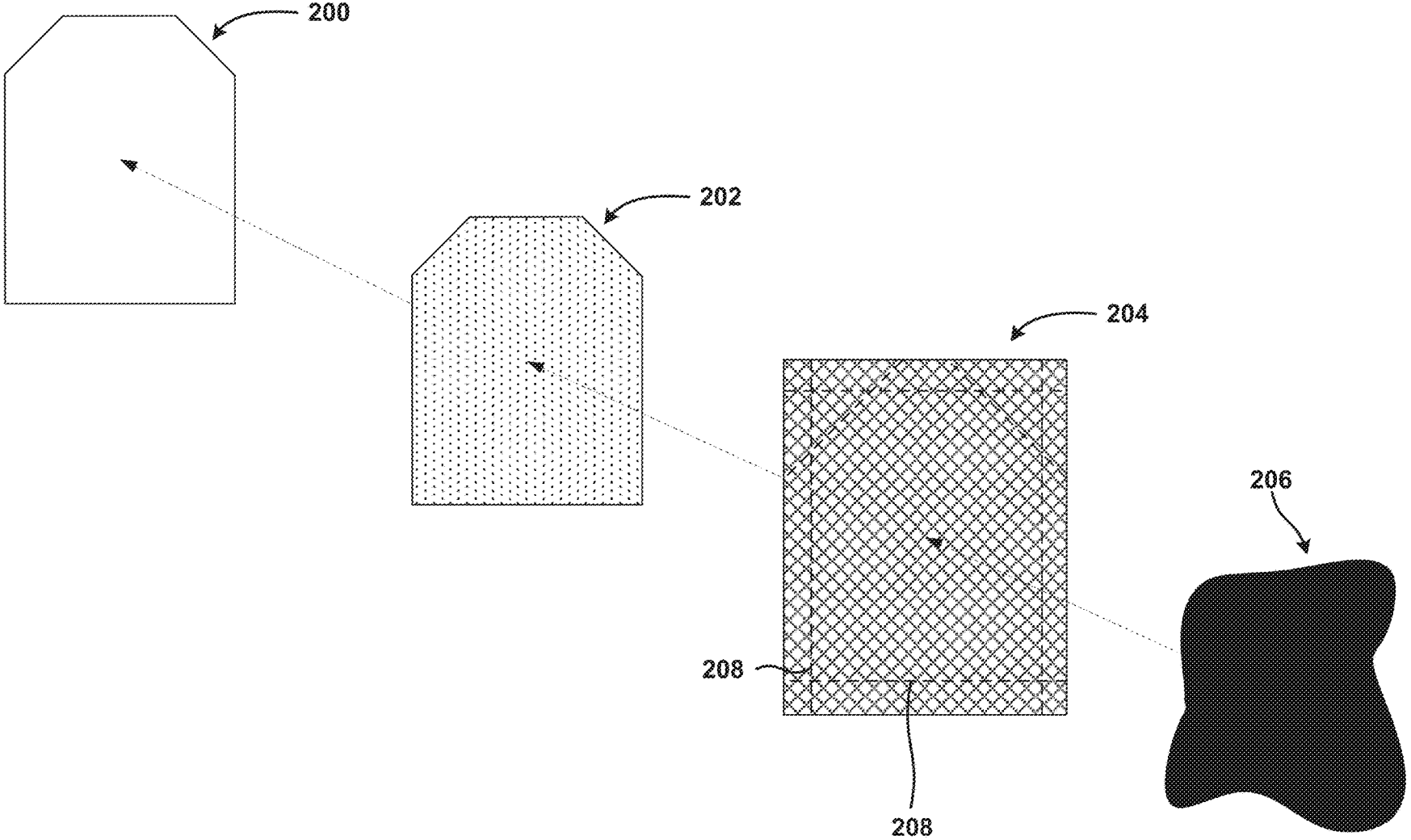
FIG. 2 is a line drawing illustrating an exploded assembly view of an armored plate assembly, according to an illustrative embodiment of the concepts and technologies disclosed herein.

Turning now to FIG. 2, an exploded view of an armored plate assembly 100 will be illustrated and described, according to an illustrative embodiment of the concepts and technologies disclosed herein. As shown in FIG. 2, the illustrated embodiment of the armored plate assembly 100 can be provided in some embodiments by the assembly of multiple components and/or materials. In particular, FIG. 2 illustrates an example embodiment of the armored plate assembly 100, where the armored plate assembly 100 can be formed by an armor plate subassembly and a coating of a material, as will be explained in more detail herein. The armor plate subassembly can include a base plate 200, a gap layer 202, and a secondary plate 204. This armor plate subassembly can be coated by a coating 206, which in the illustrated embodiment can include a layer of polyurea or another material. As shown in FIG. 2, the secondary plate 204 can have fold lines 208. These fold lines may or may not be visible, and are shown for purposes of illustrating and describing embodiments of the concepts and technologies disclosed herein. As such, it should be understood that this example is illustrative, and therefore should not be construed as being limiting in any way.

According to various embodiments of the concepts and technologies disclosed herein, the base plate 200 can be configured to stop a bullet or other projectile. Thus, in some embodiments, the base plate 200 can correspond to a plate for body armor, a vehicle, or the like. As is generally understood, the base plate 200 can be formed, in some embodiments, from steel. In some other embodiments, the base plate 200 can be formed from other metals, alloys, ceramics, polymers, composite materials, combinations thereof, or the like. In some embodiments, the base plate 200 can be formed from a member of the SSAB® HARDOX® family of steels (e.g., the SSAB® HARDOX® 600 brand steel); other abrasion resistant steels (e.g., AR600 steel, AR500 steel, etc.); and/or other military-rated and/or non-military-rated ballistic steel. According to various embodiments, the base plate 200 can have various thicknesses. In some embodiments, the thickness can be included in a range of thicknesses from 4.5 mm to 7 mm. In the illustrated embodiment, the base plate 200 is a steel plate having a thickness of 5 mm. Because other thicknesses are possible and are contemplated, it should be understood that the above listed example steels and thicknesses are illustrative, and therefore should not be construed as being limiting in any way.

In some embodiments of the concepts and technologies disclosed herein, the base plate 200 also can be finished and/or coated. For example, a corrosion preventative treatment and/or coating can be applied to the base plate 200 and/or the base plate 200 can be sanded and/or smoothed for various applications. It should be understood that these examples are illustrative, and therefore should not be construed as being limiting in any way.

The gap layer 202 can be provided in some embodiments by a continuous and/or non-continuous layer of material. In one contemplated embodiment, the gap layer 202 can be provided by a layer of natural cork having a thickness in a range of thicknesses from 1 mm to 7 mm, though other materials and/or other thicknesses are possible and are contemplated. In the illustrated embodiment, the gap layer 202 can be formed from natural cork having a thickness of 0.25 inches (~6.35 mm). Because other thicknesses are possible and are contemplated, it should be understood that this embodiment is only one contemplated embodiment and therefore should not be construed as being limiting in any way.

In some embodiments, for example, the gap layer 202 can be formed from one or more polymers, woods, epoxies, ribbing, honeycomb structures, foams (e.g., formed from polymers, metals, or ceramics, etc.), combinations thereof, or the like, without departing from the scope of this disclosure. In some embodiments, the gap layer 202 can be configured to create a distance between the secondary plate 204 (if included as shown in the embodiment illustrated in FIG. 2) and the base plate 200, to contain spalling, and/or prevent the spalling from easily exiting the armored plate assembly 100. Because the gap layer 202 can accomplish and/or fill other functions and/or provide other benefits, it should be understood that these examples functions/benefits are illustrative, and therefore should not be construed as being limiting in any way.

According to some embodiments of the concepts and technologies disclosed herein, the secondary plate 204 can correspond to a layer of KEVLAR® brand material, other aramids, and/or other materials such as metals, polymers, fiber/resin composites, combinations thereof, or the like. In one contemplated embodiment, the secondary plate 204 can include only one layer of KEVLAR® brand material. Thus, unless more than one layer of material is specifically recited, the secondary plate 204 can include only one layer of KEVLAR® brand material or another material.

In some embodiments, the secondary plate 204 (if included) can be configured to help arrest or otherwise stop projectile fragments (e.g., spalling) from exiting the armored plate assembly 100. In particular, when the projectile engages the base plate 200, fragments of the projectile may tend to be "sprayed" in a radial direction spreading parallel or substantially parallel to the engaged surface of the base plate 200, where the spalling may spread radially from the impact site of the projectile. In some other instances, fragments and/or the projectile itself may spread in other directions (e.g., angularly, spherically, etc.). Because the projectile may ricochet and/or fragment in almost any direction, it should be understood that the above examples are illustrative, and therefore should not be construed as being limiting in any way.

In some embodiments, the secondary plate 204 (if included) can be wrapped around the base plate layer and the gap layer 202, thereby containing the spalling and/or ricocheting or deflected projectile in the gap layer 202 and preventing secondary injury and/or damage from the projectile that engaged the base plate 200. Because the secondary plate 204 can accomplish and/or fill other functions and/or provide other benefits, it should be understood that these example functions/benefits are illustrative, and therefore should not be construed as being limiting in any way.

In some embodiments, the coating 206 can be applied to seal the armor plate subassembly of the base plate 200, the gap layer 202 (if included), and the secondary plate 204 (if included), and/or to provide additional protection from spalling. In some embodiments, the coating 206 can correspond to a layer of polyurea or other material. According to embodiments of the concepts and technologies disclosed herein, the coating 206 can correspond to a substantially continuous coating around the armor plate subassembly, wherein the armor plate substantially continuous coating can have a thickness in a range of thicknesses from approximately one sixteenth of an inch to about one quarter of an inch (i.e., about 1.5875 mm to about 6.35 mm) of polyurea. In the illustrated embodiment, the coating 206 can correspond to a substantially continuous coating of polyurea that can have a non-uniform thickness that can range from approximately 0.07 inches (~1.9 mm) to about 0.15 inches (~3.8 mm). It should be understood that this example is illustrative, and therefore should not be construed as being limiting in any way.

In some embodiments, the coating 206 also can be included to provide physical protection of the secondary plate 204 (e.g., if the secondary plate 204 is provided by aramid fibers, the coating 206 may cover and protect exposed aramid fibers). It should be understood that this example is illustrative, and therefore should not be construed as being limiting in any way. In some embodiments, the coating 206 also can be used as a decoration layer (e.g., with labeling, brand names, colors, etc.). Because the coating 206 can accomplish and/or fill other functions and/or provide other benefits, it should be understood that these examples functions/benefits are illustrative, and therefore should not be construed as being limiting in any way.

According to various embodiments of the concepts and technologies disclosed herein, the base plate 200 can be joined to the gap layer 202 by tape, adhesives, mechanical fasteners, combinations thereof, or the like. The secondary plate 204 can be attached to the base plate 200 and/or the gap layer 202 by tape, adhesives, mechanical fasteners, combinations thereof, or the like. In some other embodiments, the secondary plate 204 can be formed as a sleeve and/or as a blank with fold lines 208 (as shown in FIG. 2), and the secondary plate 204 can enwrap or encompass the base plate 200 and/or the gap layer 202. In particular, in some embodiments the secondary plate 204 can be folded along one or more fold lines 208 to wrap the secondary plate 204 around the gap layer 202 and base plate 200. This will be more apparent with reference to FIG. 3 below. At any rate, it should be understood that the illustrated embodiment is illustrative, and therefore should not be construed as being limiting in any way.

Figure 3:
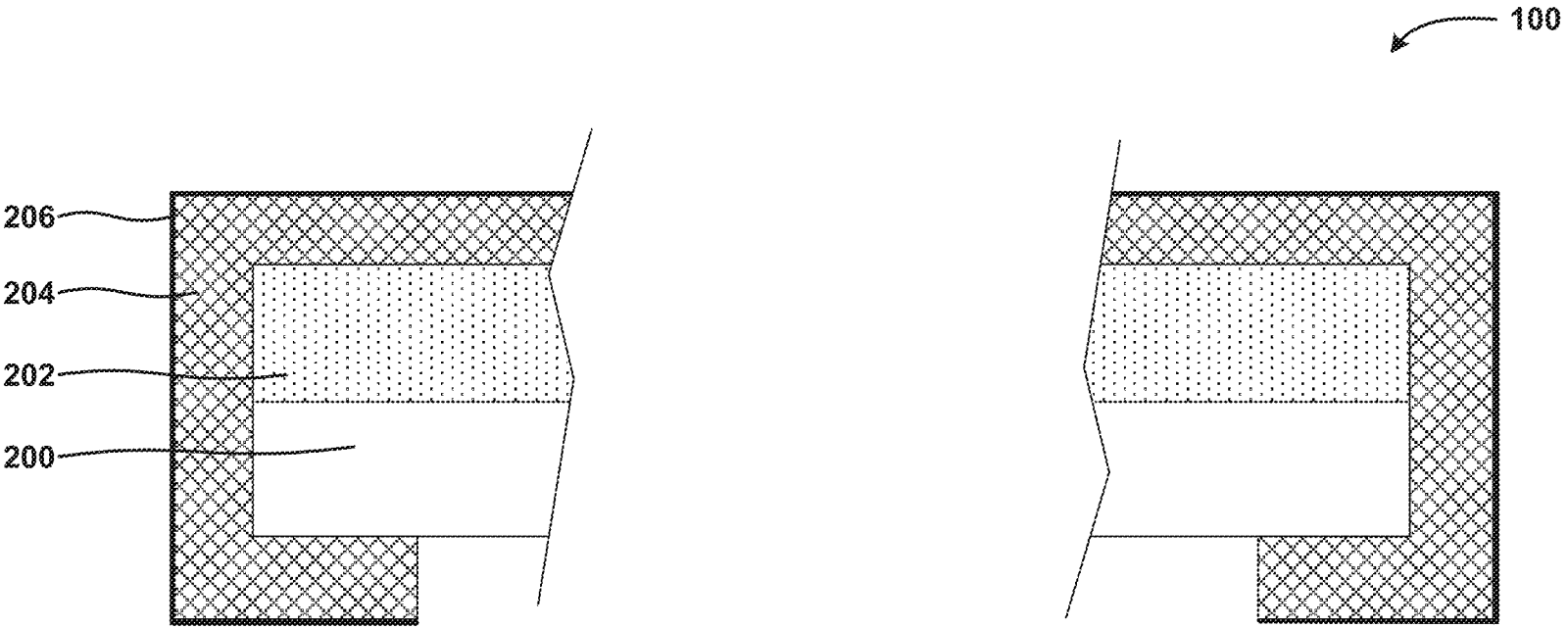
FIG. 3 is a line drawing illustrating a cross-section view of an armored plate assembly, according to an illustrative embodiment of the concepts and technologies disclosed herein.

Turning now to FIG. 3, a cross-sectional view of the armored plate assembly 100 as illustrated and described with reference to FIGS. 1A-2 is illustrated, according to an illustrative embodiment of the concepts and technologies disclosed herein. As noted above, FIG. 3 illustrates a cross-sectional view of the armored plate assembly 100 as viewed along the line A-A illustrated in FIG. 1. As can be seen in FIG. 3, the base plate 200 can be attached to or can border the gap layer 202 and the secondary plate 204 can wrap the gap layer 202 and the base plate 200. If the gap layer 202 is provided by a material (e.g., cork), for example instead of an air space, the gap layer 202 can be attached to the base plate 200. If the gap layer 202 corresponds to an air gap or chamber, the gap layer 202 can border the base plate 200. It should be understood that these examples are illustrative, and therefore should not be construed as being limiting in any way.

A layer of the coating 206 is also visible in FIG. 3, where the coating 206 wraps or encompasses, in some embodiments, at least a portion of the armor plate subassembly formed from the base plate 200 and the gap layer 202. In some other embodiments, the coating 206 can coat the entire subassembly of the base plate 200 and the gap layer 202. The coating 206 can serve multiple purposes. In addition to providing additional strength and/or protection against spalling, the coating 206 also can protect against corrosion and/or other physical damage during shipping, storage, and/or use. Because the coating 206 can cover any amount of the armor plate subassembly, and because the coating 206 can provide additional and/or alternative benefits, it should be understood that the above examples are illustrative, and therefore should not be construed as being limiting in any way.

Figure 4:
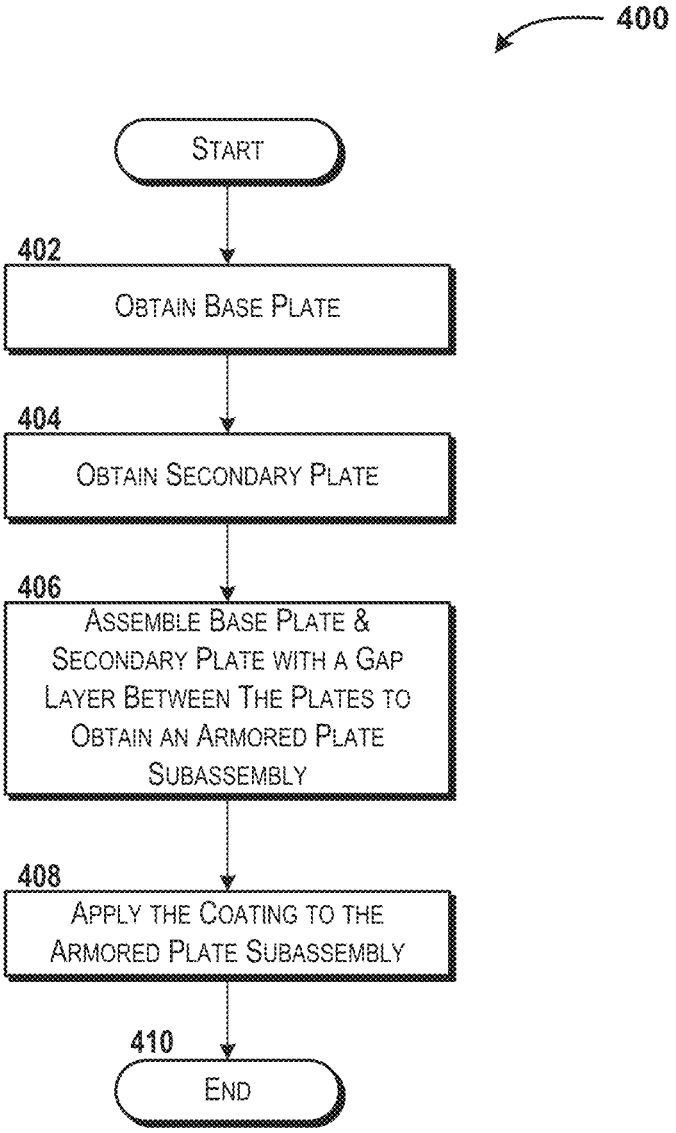
FIG. 4 is a flow diagram showing aspects of a method for forming an armored plate assembly, according to an illustrative embodiment of the concepts and technologies described herein.

Turning now to FIG. 4, aspects of a method 400 for forming one embodiment of an armored plate assembly 100 will be described in detail, according to an illustrative embodiment of the concepts and technologies disclosed herein. It should be understood that the operations of the method 400 disclosed herein are not necessarily presented in any particular order and that performance of some or all of the operations in an alternative order(s) is possible and is contemplated. The operations of the method 400 have been presented in the demonstrated order for ease of description and illustration. Operations of the method 400 may be added, omitted, and/or performed simultaneously, without departing from the scope of the concepts and technologies disclosed herein. In some embodiments of the concepts and technologies disclosed herein, the operations of the method 400 illustrated and described herein can be performed by a computer, for example a control module for an armored plate assembly fabrication machine. It should be understood that this example is illustrative, and therefore should not be construed as being limiting in any way.

The method 400 can begin at operation 402. At operation 402, a base plate 200 can be obtained. As noted above, the base plate 200 can be formed from a suitable material such as a metal or metal alloy such as steel. As noted above with reference to FIGS. 1A-3, the base plate 200 can be formed from other materials in various embodiments. Because the base plate 200 can be formed from other materials as illustrated and described herein, it should be understood that this example is illustrative, and therefore should not be construed as being limiting in any way.

From operation 402, the method 400 can proceed to operation 404. At operation 404, a secondary plate 204 can be obtained. As explained above, the secondary plate 204 can be formed from a suitable material such as a metal or metal alloy, a polymer, a resin, an epoxy, an aramid fiber, and/or other materials. In one contemplated embodiment, the secondary plate 204 can be formed from a layer of a KEVLAR® brand material. It should be understood that this example is illustrative, and therefore should not be construed as being limiting in any way.

From operation 404, the method 400 can proceed to operation 406. At operation 406, the base plate 200 can be assembled with a gap layer 202 and the secondary plate 204. In some embodiments, the gap layer 202 can correspond to an air chamber and in some other embodiments, the gap layer 202 can correspond to a layer of material such as a ceramic, a wood (e.g., cork), a polymer, combinations thereof, or the like. Thus, the gap layer 202 can be formed by disposing one or more spacers between the secondary plate 204 and the base plate 200 in some embodiments, or by locating a material such as cork between the secondary plate 204 and the base plate 200 in some other embodiments. After encompassing or enwrapping the base plate 200 and the gap layer 202 with the secondary plate 204, an armor plate subassembly that includes the base plate 200, the gap layer 202, and the secondary plate 204, can be obtained. It should be understood that this example is illustrative, and therefore should not be construed as being limiting in any way.

From operation 406, the method 400 can proceed to operation 408. At operation 408, the coating 206 can be applied to the armor plate subassembly obtained in operation 406. As explained above, in some embodiments, the coating 206 can correspond to polyurea, which can be sprayed onto or otherwise disposed to the armor plate subassembly obtained in operation 406. It should be understood that this example is illustrative, and therefore should not be construed as being limiting in any way.

From operation 408, the method 400 can proceed to operation 410. The method 400 can end at operation 410.

Figure 5A:
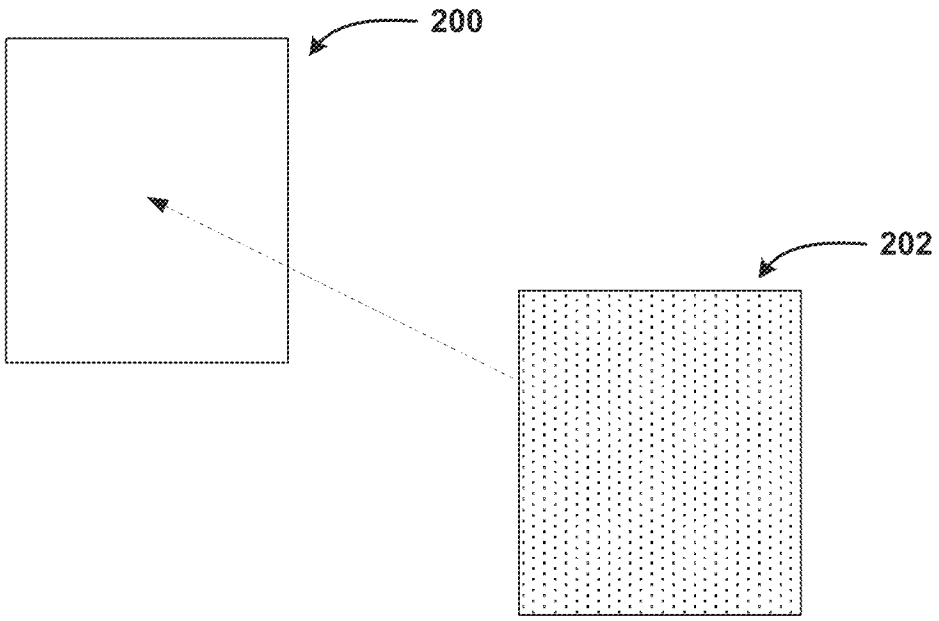
FIGS. 5A-5E are line drawings illustrating additional aspects of an armored plate assembly, according to another illustrative embodiment of the concepts and technologies disclosed herein.

Turning now to FIGS. 5A-5E, some additional aspects of an armored plate assembly 100 will be illustrated and described, according to another illustrative embodiment of the concepts and technologies disclosed herein. In particular, FIG. 5A illustrates the assembly of a base plate 200 with a gap layer 202 (e.g., without including a secondary plate 204). In the embodiment illustrated in FIG. 5A, the base plate 200 can be formed from steel or another material (e.g., including the materials set forth with respect to the base plate 200 illustrated and described above with reference to FIGS. 1A-3), and the gap layer 202 can be formed from natural cork or another material (e.g., including the materials set forth with respect to the gap layer 202 illustrated and described above with reference to FIGS. 1A-3).

In some other embodiments of the concepts and technologies disclosed herein, gap layer 202 of the embodiment shown in FIG. 5A can be formed from materials illustrated and described with reference to the secondary plate 204 of the embodiment shown in FIGS. 1A-3, though this is not a preferred embodiment. Thus, for purposes of the claims, the recitation "gap layer" excludes steel, aramids such as KEVLAR® brand materials, or the like unless specially recited in the claims. In various embodiments of the concepts and technologies disclosed herein, the base plate 200 can be attached to and/or otherwise assembled with the gap layer 202, and then additional structures can be attached to this assembly, as will be shown in FIG. 5B. It should be understood that this example is illustrative, and therefore should not be construed as being limiting in any way.

Figure 5B:
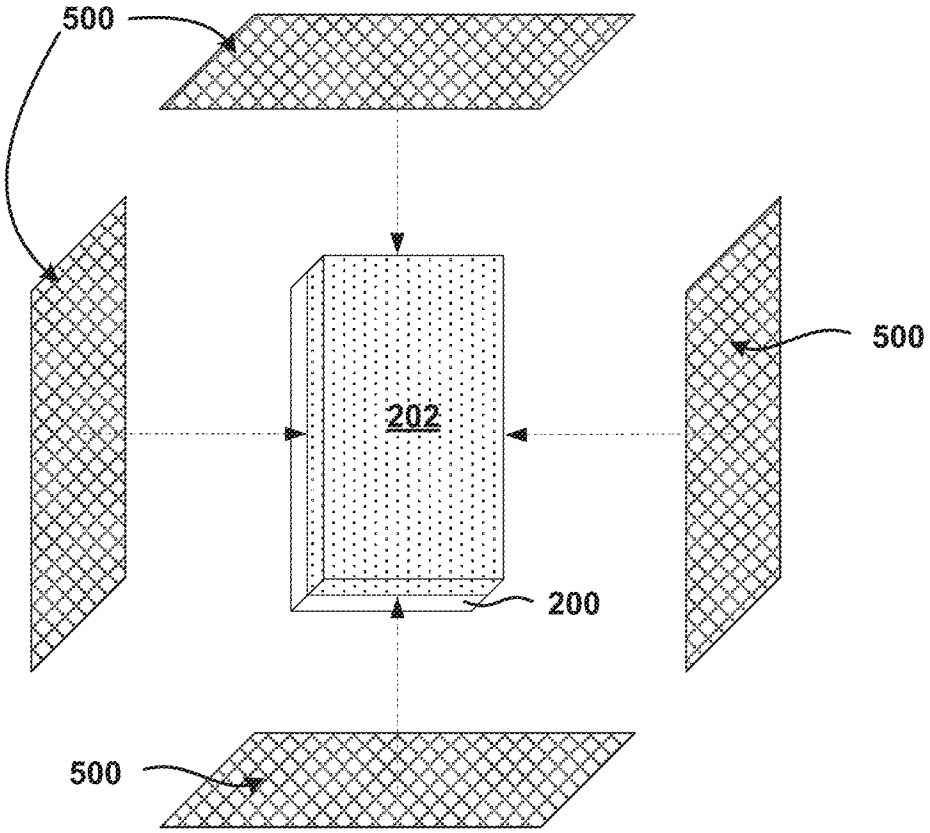

Turning now to FIG. 5B, one or more containment structures or layers of material (hereinafter referred to as a "containment layer") 500 can be applied to the assembled base plate 200 and gap layer 202. In some embodiments, the containment layer 500 can correspond to multiple pieces of KEVLAR® brand tape or other materials than can wrap around the edges of the assembly of the base plate 200 to the gap layer 202. In some other embodiments, the containment layer 500 can correspond to one or more pieces of plastic, rubber, or other materials. It should be understood that these example embodiments are illustrative, and therefore should not be construed as being limiting in any way.

Figure 5C:
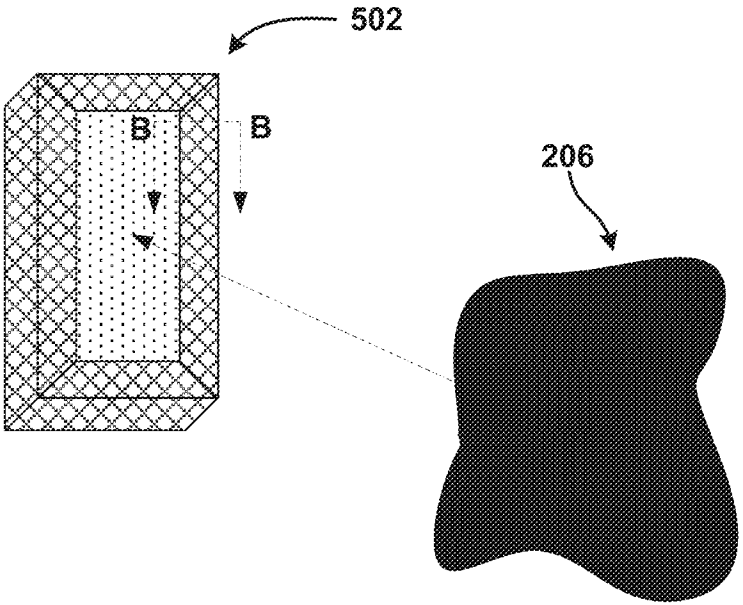

As shown in FIG. 5C, an armored plate subassembly 502 in accordance with the embodiment illustrated in FIGS. 5A-5B can be obtained by applying the containment layer 500 to the assembled base plate 200 and gap layer 202. A coating of polyurea or other embodiment of the coating 206 can be applied to the armored plate subassembly 502 (which as noted above can include the base plate 200, the gap layer 202, and the containment layer(s) 500), in some embodiments. It should be understood that this example is illustrative, and therefore should not be construed as being limiting in any way.

Figure 5D:
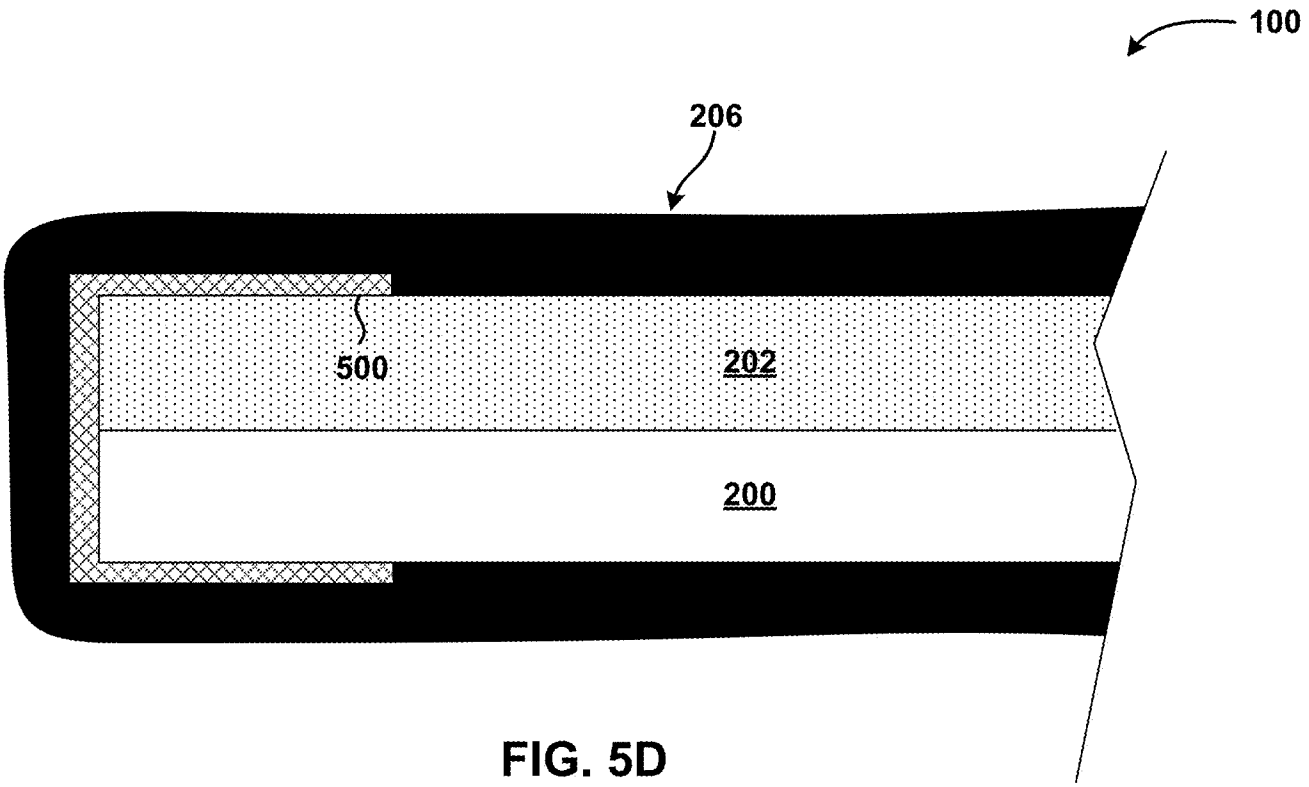

Turning to FIG. 5D, a portion of a cross-sectional view of the armored plate assembly 100 formed using the methodology schematically illustrated in FIGS. 5A-5C can be seen, as viewed along the line B-B shown in FIG. 5C. As shown in FIG. 5D, the containment layer 500 can wrap around some, a portion of, and/or all of the assembled base plate 200 and gap layer 202, and the entire resulting armored plate subassembly 502 (of the base plate 200, gap layer 202, and containment layer 500) can be coated by the coating 206. In the illustrated embodiment, the containment layer 500 is illustrated as wrapping around edges of the armored plate subassembly 502 (where the edges can correspond to edges of the base plate 200 and the gap layer 202). It should be understood that this example is illustrative, and therefore should not be construed as being limiting in any way.

Figure 5E:
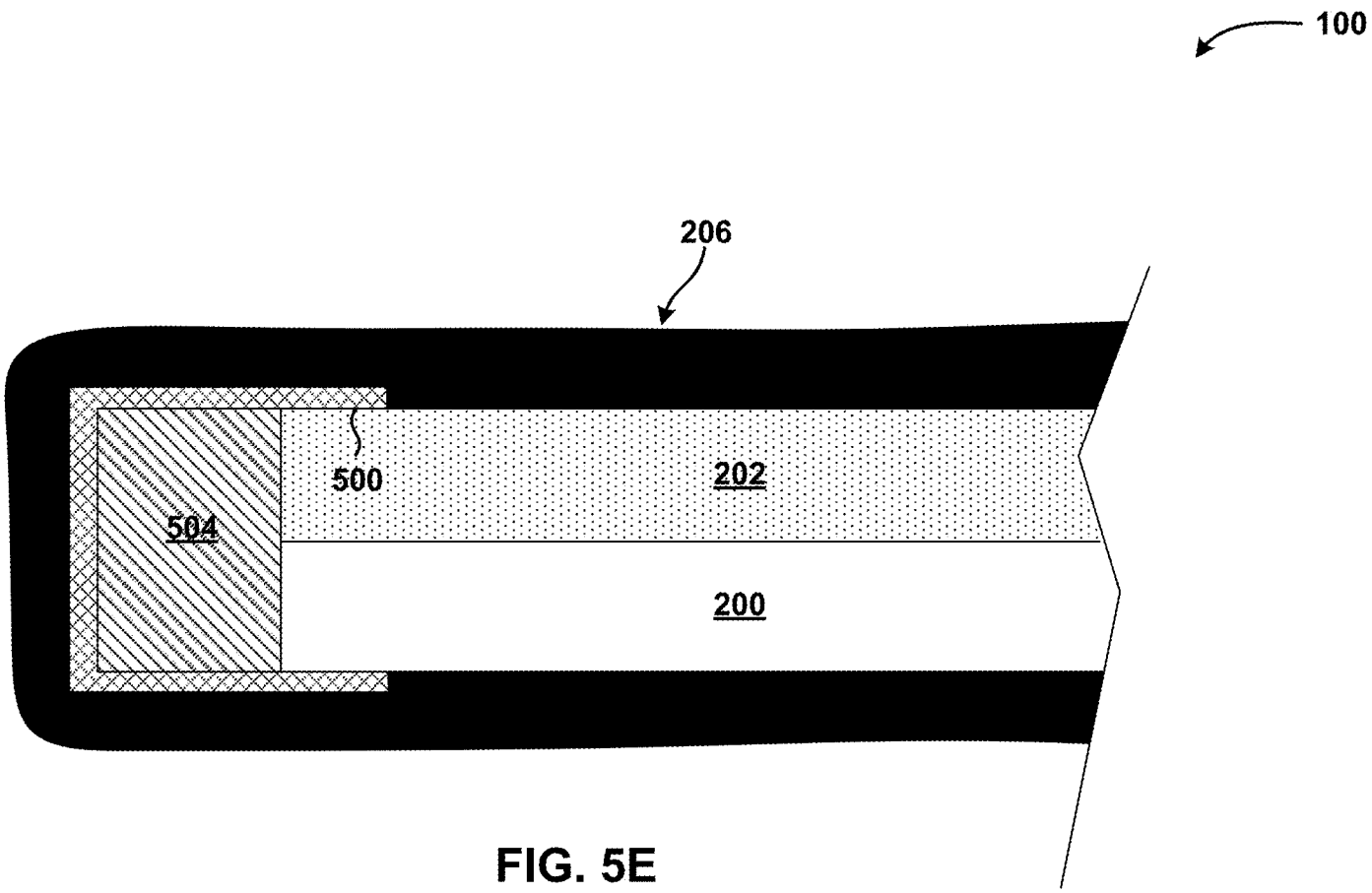

As shown in FIG. 5E, another embodiment of the armored plate assembly 100 can include an assembly of the base plate 200 to the gap layer 202, with a cork layer or other material acting as an edge structure (referred to herein as an "edge structure") 504, and a containment layer 500 as illustrated and described above; which collectively can form another subassembly, which can be coated by polyurea or other embodiment of the coating 206. According to various embodiments, the edge structure 504 can be formed from cork, metal, a KEVLAR® brand material, a rubber, a plastic or other polymer (e.g., manmade rubber, nitrile rubber, or other materials) or other materials. In some embodiments, the edge structure 504 can be included to reinforce edges of the armor plate subassembly (of the base plate 200 and the secondary plate 204), to contain spall, and/or for other purposes. It should be understood that this example is illustrative, and therefore should not be construed as being limiting in any way.

Figure 6:
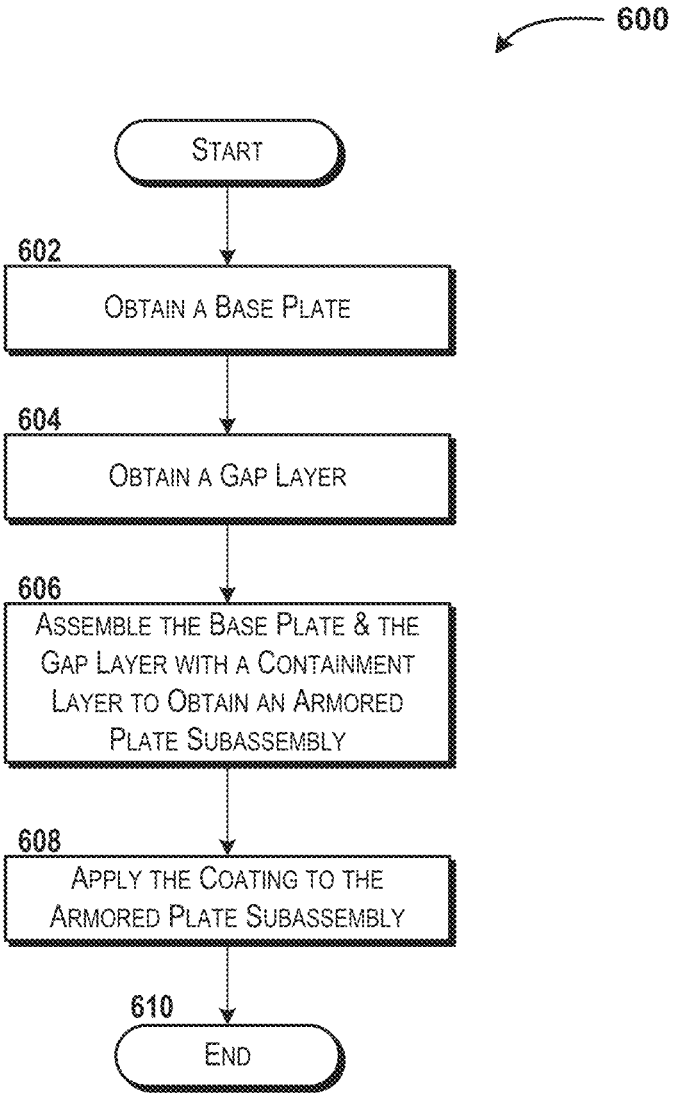
FIG. 6 is a flow diagram showing aspects of a method for forming an armored plate assembly, according to an illustrative embodiment of the concepts and technologies described herein.

Turning now to FIG. 6, aspects of a method 600 for forming an armored plate assembly 100 will be described in detail, according to another illustrative embodiment of the concepts and technologies disclosed herein. It should be understood that the operations of the method 600 disclosed herein are not necessarily presented in any particular order and that performance of some or all of the operations in an alternative order(s) is possible and is contemplated. The operations of the method 600 have been presented in the demonstrated order for ease of description and illustration. Operations of the method 600 may be added, omitted, and/or performed simultaneously, without departing from the scope of the concepts and technologies disclosed herein. In some embodiments of the concepts and technologies disclosed herein, the operations of the method 600 illustrated and described herein can be performed by a computer, for example a control module for an armored plate assembly fabrication machine. It should be understood that this example is illustrative, and therefore should not be construed as being limiting in any way.

The method 600 can begin at operation 602. At operation 602, a base plate 200 can be obtained. As noted above, the base plate 200 can be formed from a suitable material such as a metal or metal alloy such as steel. As noted above with reference to FIGS. 1A-5E, the base plate 200 can be formed from other materials in various embodiments. Because the base plate 200 can be formed from other materials as illustrated and described herein, it should be understood that this example is illustrative, and therefore should not be construed as being limiting in any way.

From operation 602, the method 600 can proceed to operation 604. At operation 604, a gap layer 202 can be obtained. As explained above, the gap layer 202 can correspond to a layer of material such as a ceramic, a wood (e.g., cork), a polymer, a resin, an epoxy, and/or other materials. According to various embodiments of the concepts and technologies disclosed herein, the gap layer 202 can be provided by a layer of natural cork. It should be understood that these example materials are illustrative, and therefore should not be construed as being limiting in any way.

From operation 604, the method 600 can proceed to operation 606. At operation 606, the base plate 200 can be assembled with the gap layer 202 and, in some embodiments, one or more edge structures 504, and this subassembly (including or excluding the edge structures 504) can be further assembled with one or more containment layer(s) 500. In some embodiments, the containment layer(s) 500 can correspond to a layer of KEVLAR® brand tape, etc., which can be used to reinforce or strengthen the edges of the armor plate subassembly and/or for other reasons. In some other embodiments, as noted above, the containment layer 500 can include and/or can be provided by a layer or portion of rubber, polymer, and/or other materials such as a nitrile rubber. In some embodiments, the containment layer 500 can be wrapped around the edges of the base plate 200 and the gap layer 202 (and, optionally, the edge structure 504), as shown in FIGS. 5A-5E, for example. After encompassing or enwrapping some, a portion of, and/or all of the base plate 200 and the gap layer 202 (and optionally the edge structure 504) with the containment layer 500, an armored plate subassembly 502 that includes the base plate 200, the gap layer 202, the edge structure 504 (if included), and the containment layer 500 can be obtained. It should be understood that this example is illustrative, and therefore should not be construed as being limiting in any way.

From operation 606, the method 600 can proceed to operation 608. At operation 608, the coating 206 can be applied to the armored plate subassembly 502 obtained in operation 606. As explained above, in some embodiments, the coating 206 can correspond to polyurea, which can be sprayed onto the armored plate subassembly 502 obtained in operation 606. It should be understood that this example is illustrative, and therefore should not be construed as being limiting in any way.

From operation 608, the method 600 can proceed to operation 610. The method 600 can end at operation 610.

Figure 7A:
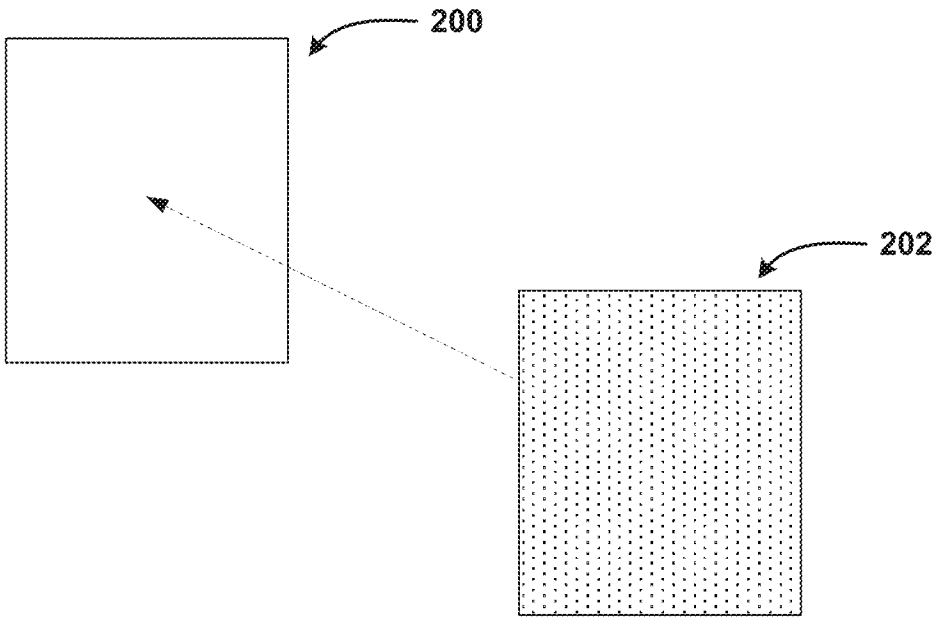
FIGS. 7A-7D are line drawings illustrating additional aspects of an armored plate assembly, according to yet another illustrative embodiment of the concepts and technologies disclosed herein.

Turning now to FIGS. 7A-7D, some additional aspects of an armored plate assembly 100 will be illustrated and described, according to another illustrative embodiment of the concepts and technologies disclosed herein. In particular, FIG. 7A illustrates the assembly of a base plate 200 with a gap layer 202 (e.g., without a secondary plate 204). In the embodiment illustrated in FIG. 7A, the base plate 200 can be formed from steel or another material (e.g., including the materials set forth with respect to the base plate 200 illustrated and described above with reference to FIGS. 1A-6), and the gap layer 202 can be formed from natural cork or another material (e.g., including the materials set forth with respect to the gap layer 202 illustrated and described above with reference to FIGS. 1A-6). In various embodiments of the concepts and technologies disclosed herein, a subassembly can be obtained by assembling the base plate 200 to the gap layer 202, in some embodiments. It should be understood that this example is illustrative, and therefore should not be construed as being limiting in any way.

Figure 7B:
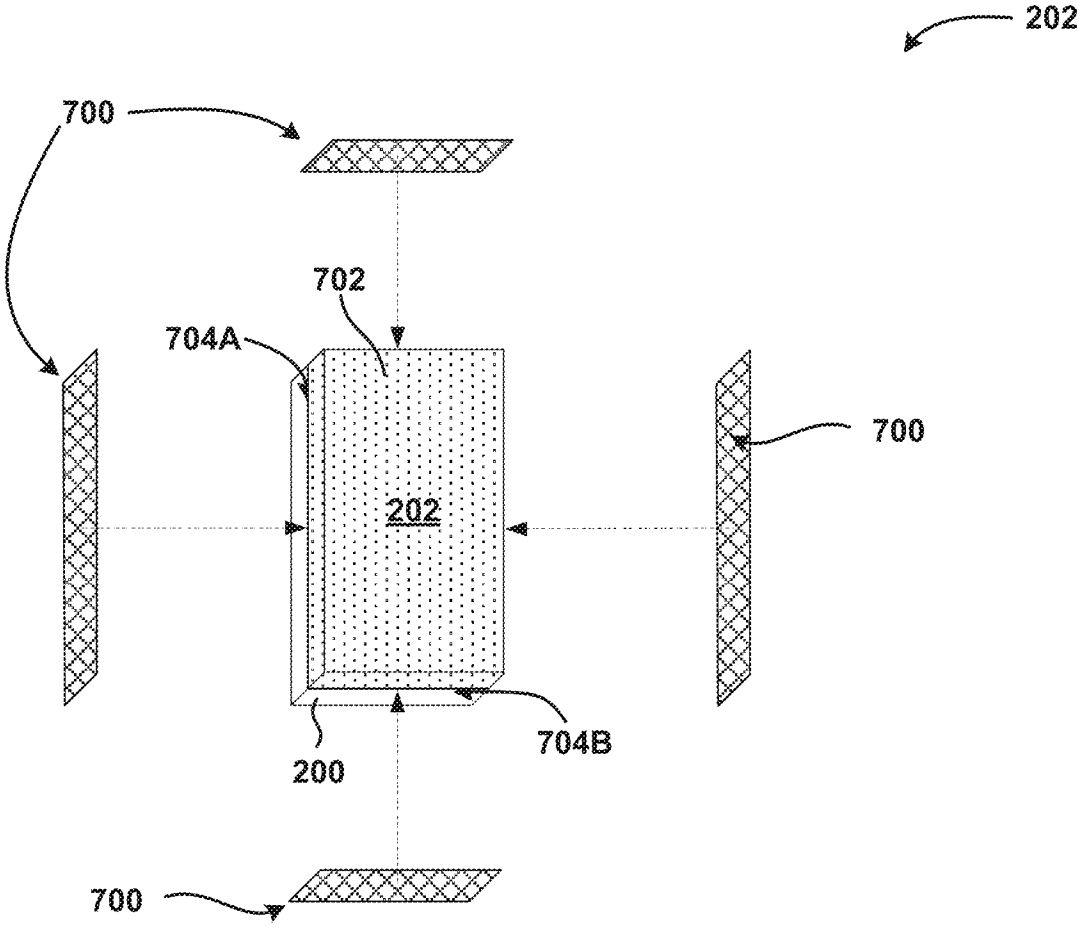

As shown in FIG. 7B, one or more containment structures or layers of material (hereinafter referred to as a "containment structure") 700 can be applied to an armor plate subassembly that can be formed by the assembly of the base plate 200 to the gap layer 202. It should be understood that in some embodiments, the containment structure 700 can correspond to one or more pieces of natural or synthetic rubbers or other polymers, and/or other materials than can be located along edges of the assembly of the base plate 200 to the gap layer 202 to reinforce these edges and/or to attempt to prevent spall from exiting the armored plate assembly 100. In the illustrated embodiment, the functionality of the containment structure 700 can be provided by one or more pieces of 70 durometer nitrile rubber ("NBR-70") or other materials. In the illustrated embodiment, the containment structure 700 can have a thickness of approximately 0.25 inches (~6.35 mm). Because other materials and/or thicknesses of materials for the containment structures 700 are possible and are contemplated, it should be understood that this example embodiment is illustrative, and therefore should not be construed as being limiting in any way.

As shown in FIG. 7B, the subassembly formed by the assembling the base plate 200 to the gap layer 202 can have a facing surface 702, a rear surface (not visible in FIG. 7B), and one or more periphery edges 704A-B (hereinafter collectively and/or generically referred to as "edges 704"). It can be appreciated that the additional two edges 704 of the armor plate subassembly are not visible in the view illustrated in FIG. 7B.

According to various embodiments of the concepts and technologies disclosed herein, the containment structure(s) 700 can be applied to the armor plate subassembly such that the containment structure(s) 700 can be located at or near, or can engage, the edges 704. In some embodiments, the containment structure(s) 700 can be configured to reinforce or strengthen the edges 704. In some other embodiments, such as the embodiment shown in FIG. 7B, the containment structure(s) 700 can be included to prevent (or at least reduce) penetration of spall from within the armored plate assembly 100 to outside the armored plate assembly 100. It should be understood that this example is illustrative, and therefore should not be construed as being limiting in any way.

According to various embodiments of the concepts and technologies disclosed herein, the containment structure(s) 700 can be joined to the edges 704 of the assembled base plate 200 and gap layer 202 using an adhesive such as a glue or epoxy. In some embodiments, the glue can include a urethane-based glue and/or other types of adhesives. In the illustrated embodiment, the containment structure(s) 700 can be joined to the edges 704 of the assembled base plate 200 and gap layer 202 using an adhesive referred to as ADTHANE 1800. Because other adhesives and/or mechanical fasteners are possible and are contemplated, it should be understood that this example embodiment is illustrative, and therefore should not be construed as being limiting in any way.

Figure 7C:
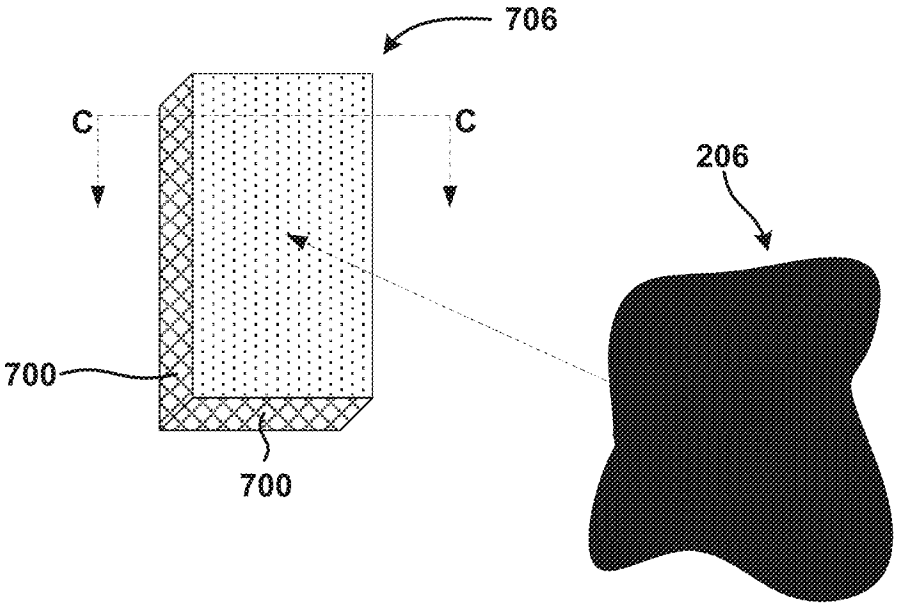

As shown in FIG. 7C, an armored plate subassembly 706 can be obtained by applying the containment structure(s) 700 to the edges 704 of the assembled base plate 200 and gap layer 202, as illustrated and described above with reference to FIG. 7B. As shown in FIG. 7C, the containment structure 700 can cover one or more and/or all edges 704 of the assembled base plate 200 and gap layer 202, though only two edges 704 are visible in the perspective view shown in FIG. 7C. A coating 206 (e.g., a layer of polyurea or other embodiment of the coating 206) can be applied to the armored plate subassembly 706, in some embodiments, thereby encompassing the base plate 200, the gap layer 202, and the containment structure(s) 700. It should be understood that this example is illustrative, and therefore should not be construed as being limiting in any way.

Figure 7D:
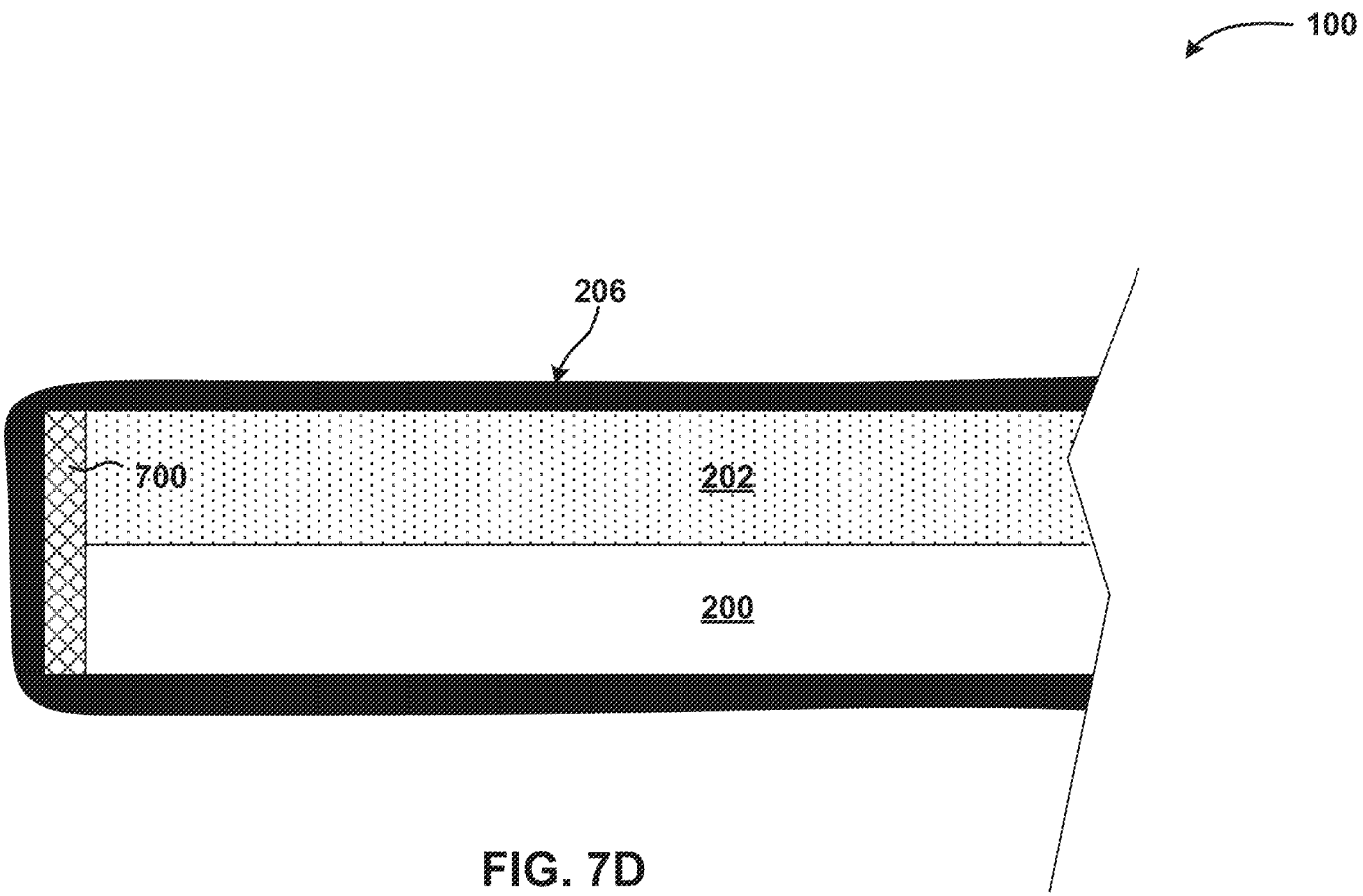

Turning to FIG. 7D, a portion of a cross-sectional view of the armored plate assembly 100 formed using the methodology schematically illustrated in FIGS. 7A-7C is illustrated, as viewed along view line C-C illustrated in FIG. 7C. As shown in FIG. 7D, the containment structure(s) 700 can run along or next to the edges 704 of the assembled base plate 200 and gap layer 202, and the entire armored plate subassembly 706 (including the containment structure(s) 700) can be coated by the coating 206. It should be understood that this example is illustrative, and therefore should not be construed as being limiting in any way.

Figure 8:
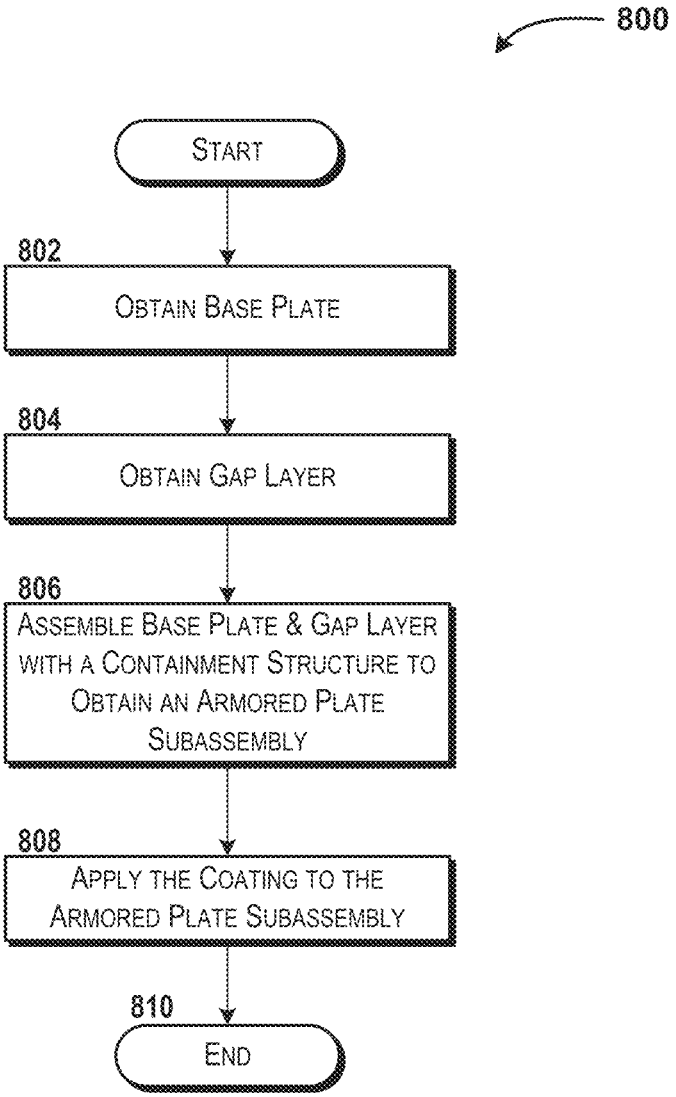
FIG. 8 is a flow diagram showing aspects of a method for forming an armored plate assembly, according to an illustrative embodiment of the concepts and technologies described herein.

Turning now to FIG. 8, aspects of a method 800 for forming an armored plate assembly 100 will be described in detail, according to another illustrative embodiment of the concepts and technologies disclosed herein. It should be understood that the operations of the method 800 disclosed herein are not necessarily presented in any particular order and that performance of some or all of the operations in an alternative order(s) is possible and is contemplated. The operations of the method 800 have been presented in the demonstrated order for ease of description and illustration. Operations of the method 800 may be added, omitted, and/or performed simultaneously, without departing from the scope of the concepts and technologies disclosed herein. In some embodiments of the concepts and technologies disclosed herein, the operations of the method 800 illustrated and described herein can be performed by a computer, for example a control module for an armored plate assembly fabrication machine. It should be understood that this example is illustrative, and therefore should not be construed as being limiting in any way.

The method 800 can begin at operation 802. At operation 802, a base plate 200 can be obtained. As noted above, the base plate 200 can be formed from a suitable material such as a metal or metal alloy such as steel. It should be understood that this example is illustrative, and therefore should not be construed as being limiting in any way.

From operation 802, the method 800 can proceed to operation 804. At operation 804, a gap layer 202 can be obtained. As explained above, the gap layer 202 can be formed from a suitable material such as a polymer, a resin, an epoxy, wood, natural or manmade cork, steel wool, fibers, and/or other materials. In the embodiment shown in FIGS. 7A-7D, the gap layer 202 can be formed from natural cork. It should be understood that these example materials are illustrative, and therefore should not be construed as being limiting in any way.

From operation 804, the method 800 can proceed to operation 806. At operation 806, the base plate 200 can be assembled with the gap layer 202 and, in some embodiments, one or more containment structure(s) 700. In some embodiments, the containment structure 700 can correspond to a layer or piece of plastic, rubber, nitrile, a polymer, KEVLAR® brand tape, other materials, combinations thereof, or the like; which can be used to attempt to prevent (or at least reduce) penetration of spall from within the armored plate assembly 100 to outside of the armored plate assembly 100 as illustrated and described herein.

In some embodiments, the containment structure(s) 700 can be located next to the edges 704 of assembled base plate 200 and gap layer 202, as shown in FIGS. 7A-7D, for example. After locating the containment structure(s) 700 along edges 704 of the assembled base plate 200 and gap layer 202, an armored plate subassembly 706 that includes the base plate 200, the gap layer 202, and the containment structure(s) 700 can be obtained. It should be understood that this example is illustrative, and therefore should not be construed as being limiting in any way.

From operation 806, the method 800 can proceed to operation 808. At operation 808, the coating 206 can be applied to the armored plate subassembly 706. As explained above, in some embodiments, the functionality of the coating 206 can be provided in various embodiments by a coating of polyurea, which can be sprayed onto the armored plate subassembly 706. It should be understood that this example is illustrative, and therefore should not be construed as being limiting in any way.

From operation 808, the method 800 can proceed to operation 810. The method 800 can end at operation 810.

Figure 9A:
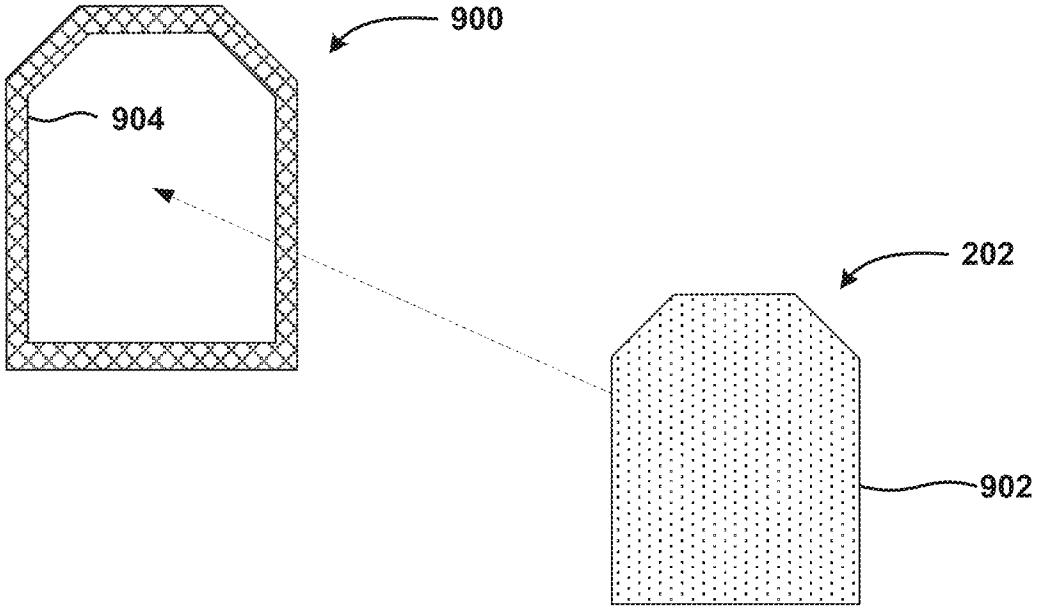
FIGS. 9A-9E are line drawings illustrating additional aspects of an armored plate assembly, according to yet another illustrative embodiment of the concepts and technologies disclosed herein.

Turning now to FIGS. 9A-9E, some additional aspects of an armored plate assembly 100 will be illustrated and described, according to yet another illustrative embodiment of the concepts and technologies disclosed herein. In particular, FIG. 9A illustrates how a gap layer 202 can be assembled with a containment structure 900. As can be appreciated with reference to FIG. 9A, the outer edges or outer perimeter ("outer edges") 902 of the gap layer 202 can be configured and dimensioned to substantially match the inner edges or inner perimeter ("inner edges") 904 of the containment structure 900, though this is not necessarily the case. It should be understood that in various embodiments of the concepts and technologies disclosed herein, the containment structure 900 can have a thickness that is substantially similar to a thickness of the gap layer 202, though this is not necessarily the case. As such, it should be understood that the illustrated example is illustrative, and therefore should not be construed as being limiting in any way.

In some embodiments of the concepts and technologies disclosed herein, the dimensions of a perimeter of the inner edges 904 can be slightly smaller than the dimensions of the perimeter of the outer edges 902. In such embodiments, the gap layer 202 and the containment structure 900 can be held together (after assembly) by a force generated between the outer edges 902 and the inner edges 904. Because other structures, chemicals, and/or materials can be used to hold the gap layer 202 and the containment structure 900 together (e.g., adhesives, staples, etc.), it should be understood that this example embodiment is illustrative, and therefore should not be construed as being limiting in any way.

According to various embodiments of the concepts and technologies disclosed herein, the containment structure 900 can correspond to one or more pieces of natural or synthetic rubbers or other polymers, and/or other materials than can be located along edges of the assembly of the gap layer 202. In the illustrated embodiment, the functionality of the containment structure 900 can be provided by a substantially continuous gasket formed from 70 durometer nitrile rubber ("NBR-70") or other materials. In the illustrated embodiment, the containment structure 900 can have a thickness (the dimension from the visible plane of the containment structure 900 in FIG. 9A to the rear plane (not visible in FIG. 9A)) of approximately 0.25 inches (~6.35 mm). Because other materials and/or thicknesses of materials for the containment structures 900 are possible and are contemplated, it should be understood that this example embodiment is illustrative, and therefore should not be construed as being limiting in any way.

In the illustrated embodiment of FIG. 9A, the gap layer 202 can be formed from a natural or synthetic cork, steel wool, polymers, and/or other materials. In the embodiment of FIG. 9A, the gap layer 202 is formed from natural cork. It should be understood that this example is illustrative, and therefore should not be construed as being limiting in any way.

Figure 9B:
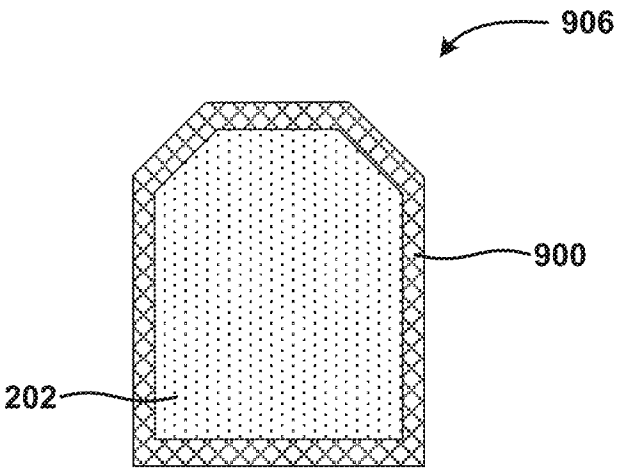

As shown in FIG. 9B, a spall containment subassembly 906 is illustrated, according to an example embodiment of the concepts and technologies disclosed herein. As shown in FIGS. 9A-9B, the spall containment subassembly 906 can be formed by the assembling the gap layer 202 with the containment structure 900. It should be understood that this example is illustrative, and therefore should not be construed as being limiting in any way.

Figure 9C:
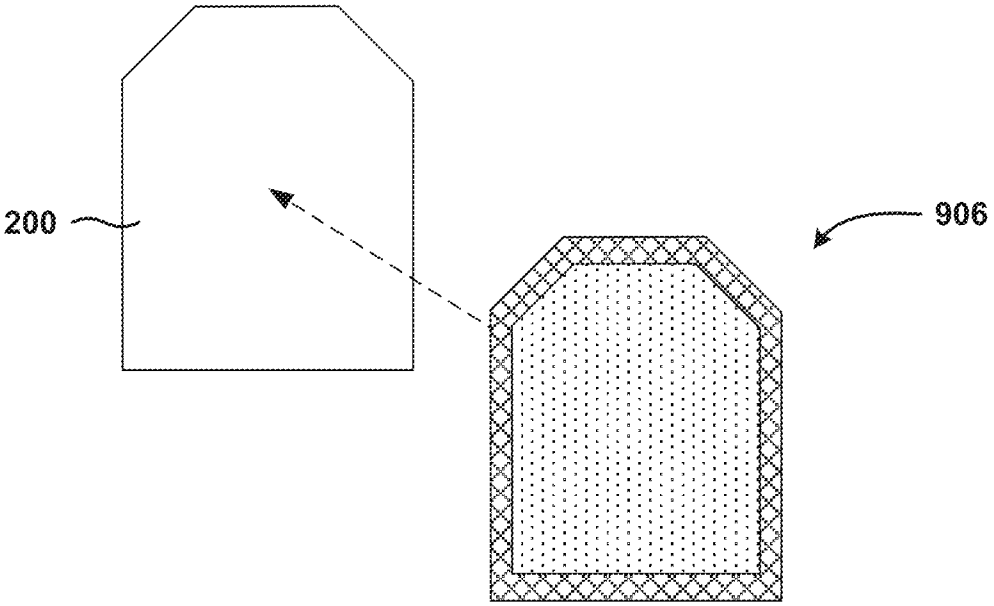

Turning now to FIG. 9C, additional aspects of the armored plate assembly 100 will be illustrated and described in more detail, according to one example embodiment of the concepts and technologies disclosed herein. As shown in FIG. 9C, the spall containment subassembly 906 can be assembled with a base plate 200. As noted above, the base plate 200 can be formed from a suitable material such as a metal or a metal alloy such as steel. It should be understood that this example is illustrative, and therefore should not be construed as being limiting in any way.

According to various embodiments of the concepts and technologies disclosed herein, the spall containment subassembly 906 can be joined to the base plate 200 using an adhesive such as a glue or epoxy. In some embodiments, the glue can include a urethane-based glue and/or other types of adhesives. In the illustrated embodiment, the spall containment subassembly 906 can be joined to the base plate 200 using an adhesive referred to as ADTHANE 1800. Because other adhesives and/or mechanical fasteners are possible and are contemplated, it should be understood that this example embodiment is illustrative, and therefore should not be construed as being limiting in any way.

Figure 9D:
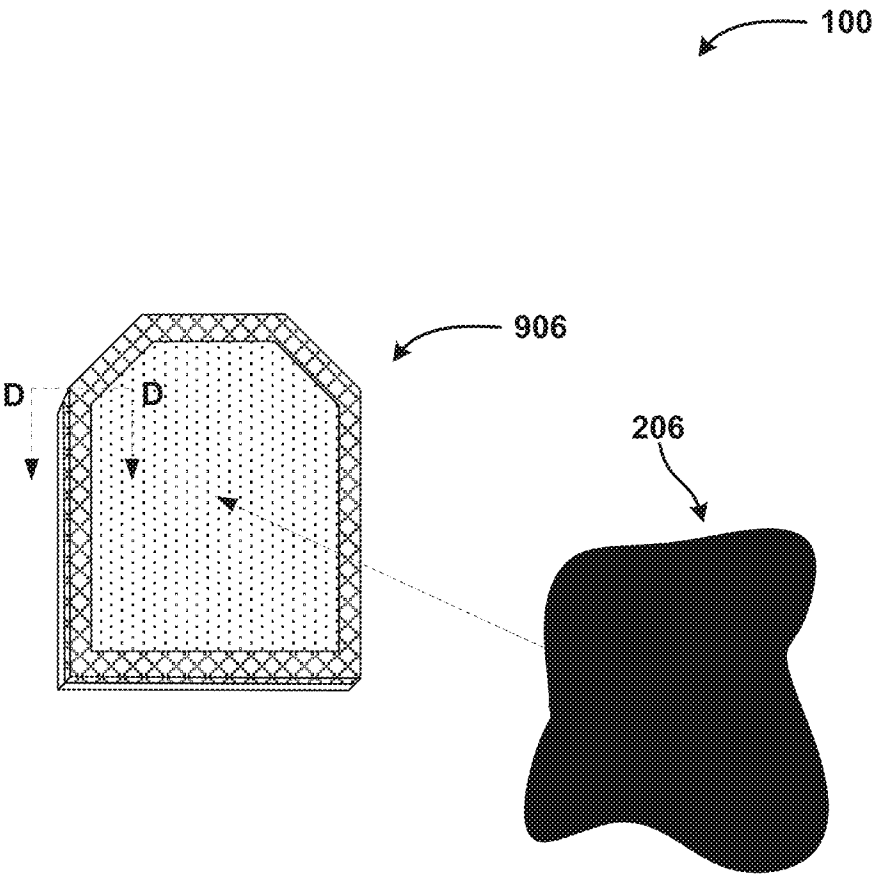

As shown in FIG. 9D, the armored plate assembly 100 can be obtained by applying a coating 206 (e.g., a layer of polyurea or other embodiment of the coating 206 as illustrated and described herein) to the assembled spall containment subassembly 906 and base plate 200. According to various embodiments of the concepts and technologies disclosed herein, the coating 206 can encompass some or the entirety of the assembled base plate 200 and some or all of the spall containment subassembly 906. In the illustrated embodiment, the coating 206 can coat substantially all of the exposed exterior of the assembled base plate 200 and spall containment subassembly 906. It should be understood that this example is illustrative, and therefore should not be construed as being limiting in any way.

Figure 9E:
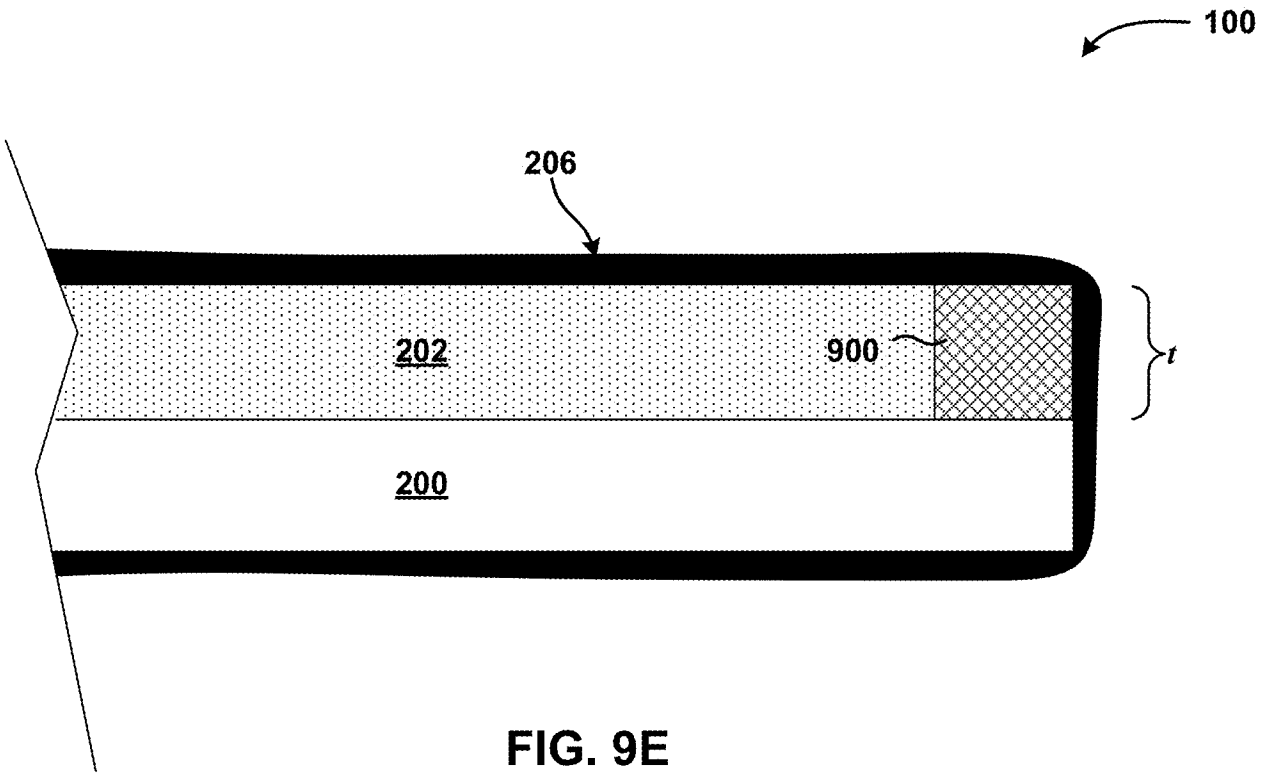

Turning to FIG. 9E, a portion of a cross-sectional view of the armored plate assembly 100 formed using the methodology schematically illustrated in FIGS. 9A-9D is illustrated, as viewed along view line D-D illustrated in FIG. 9D. As shown in FIG. 9E, the containment structure 900 can be located in the plane of the gap layer 202. Although the containment structure 900 and the gap layer 202 are shown as having the substantially the same thickness t, it should be understood that this is not necessarily the case in all embodiments. As shown in FIG. 9E, the entire exterior surface of the assembled base plate 200 and spall containment subassembly 906 can be coated by the coating 206. It should be understood that this example is illustrative, and therefore should not be construed as being limiting in any way.

Embodiments of the armored plate assembly 100 as shown in FIG. 9E have been tested and determined to reduce or even prevent edge failure of the armored plate assembly 100 that results from spalling or other causes when engaged by projectiles fired from firearms in the calibers of .223 Remington, 556 NATO, .308 Winchester Magnum, 9 mm, and other calibers. In some embodiments, the armored plate assembly 100 has been proven to prevent edge failure of the armored plate assembly 100 that results from spalling as long as projectiles engaging the armored plate assembly 100 are at least two inches from the edge. As such, embodiments of the concepts and technologies disclosed herein have been determined to reduce or even prevent spalling from escaping the armored plate assembly 100. It should be understood that these example embodiments are illustrative, and therefore should not be construed as being limiting in any way.

Figure 10:
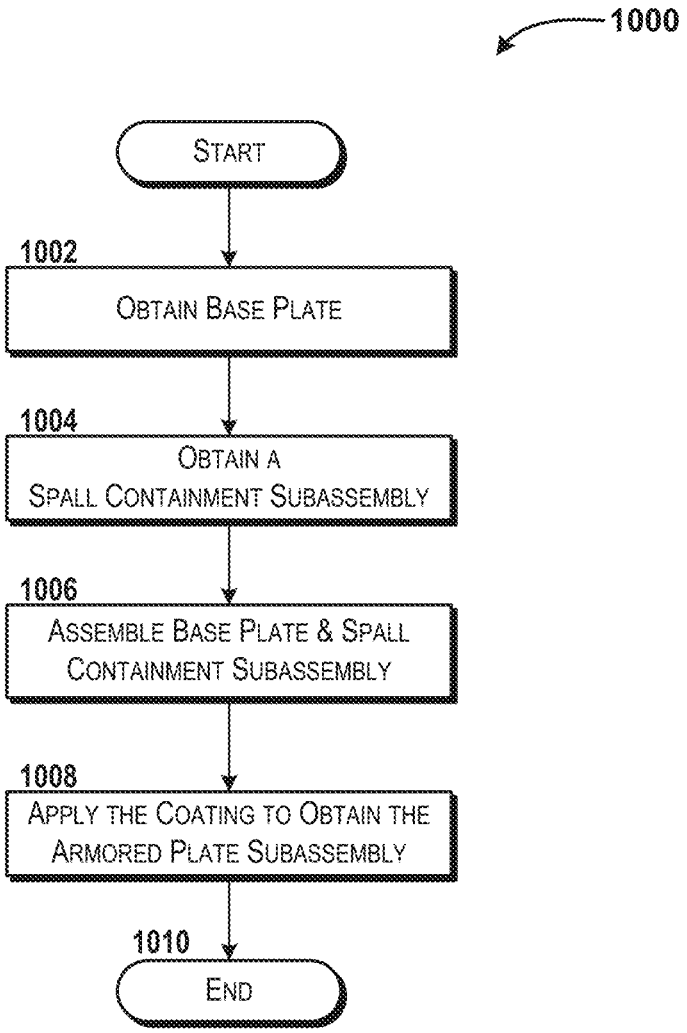
FIG. 10 is a flow diagram showing aspects of a method for forming an armored plate assembly, according to yet another illustrative embodiment of the concepts and technologies described herein.

Turning now to FIG. 10, aspects of a method 1000 for forming an armored plate assembly 100 will be described in detail, according to another illustrative embodiment of the concepts and technologies disclosed herein. It should be understood that the operations of the method 1000 disclosed herein are not necessarily presented in any particular order and that performance of some or all of the operations in an alternative order(s) is possible and is contemplated. The operations of the method 1000 have been presented in the demonstrated order for ease of description and illustration. Operations of the method 1000 may be added, omitted, and/or performed simultaneously, without departing from the scope of the concepts and technologies disclosed herein. In some embodiments of the concepts and technologies disclosed herein, the operations of the method 1000 illustrated and described herein can be performed by a computer, for example a control module for an armored plate assembly fabrication machine. It should be understood that this example is illustrative, and therefore should not be construed as being limiting in any way.

The method 1000 can begin at operation 1002. At operation 1002, a base plate 200 can be obtained. As noted above, the base plate 200 can be formed from a suitable material such as a metal or metal alloy such as steel. It should be understood that this example is illustrative, and therefore should not be construed as being limiting in any way.

From operation 1002, the method 1000 can proceed to operation 1004. At operation 1004, a spall containment subassembly 906 can be obtained. As explained above, the spall containment subassembly 906 can include the gap layer 202 and a containment structure 900. According to various embodiments of the concepts and technologies disclosed herein, the gap layer 202 can be formed from a suitable material such as a polymer, a resin, an epoxy, wood, natural or manmade cork, steel wool, fibers, and/or other materials, and the containment structure 900 can be formed from plastic, rubber, nitrile (e.g., nitrile rubber), a polymer, other materials, combinations thereof, or the like. In the embodiment illustrated in FIGS. 9A-9E, the spall containment subassembly 906 can be formed from a gap layer 202 formed from natural cork and a containment structure 900 formed from nitrile rubber. It should be understood that these example materials are illustrative, and therefore should not be construed as being limiting in any way.

From operation 1004, the method 1000 can proceed to operation 1006. At operation 1006, the base plate 200 can be assembled with the spall containment subassembly 906. In some embodiments, the spall containment subassembly 906 can be glued to the base plate 200 and/or otherwise connected or attached to the base plate 200. It should be understood that this example is illustrative, and therefore should not be construed as being limiting in any way.

From operation 1006, the method 1000 can proceed to operation 1008. At operation 1008, the coating 206 can be applied to the assembled base plate 200 and spall containment subassembly 906. As explained above, in some embodiments, the functionality of the coating 206 can be provided in various embodiments by a coating of polyurea, which can be sprayed onto the exposed exterior surfaces of the assembled base plate 200 and the spall containment subassembly 906. It should be understood that this example is illustrative, and therefore should not be construed as being limiting in any way.

From operation 1008, the method 1000 can proceed to operation 1010. The method 1000 can end at operation 1010.

According to various embodiments disclosed hereinabove, it should be understood that while the coating 206 (e.g., formed from polyurea) is mostly illustrated as being a separate component from the other components of the armored plate assembly 100 (e.g., the base plate 200, the gap layer 202, the secondary plate 204, the containment layers 500, the edge structures 504, the containment structures 700, etc.), it should be understood that some of these components of the armored plate assembly 100 can be formed from polyurea. In particular, in some embodiments of the concepts and technologies disclosed herein, the secondary plate 204 can be formed from polyurea. In one contemplated embodiment, this approach can obviate the need for KEVLAR® because a thicker layer of polyurea can serve a dual purpose (e.g., to function as a secondary plate 204 and to function as the coating 206). It should be understood that this example is illustrative, and therefore should not be construed as being limiting in any way.

In some embodiments of the concepts and technologies disclosed herein, a spacer layer can extend over the edges of the armor plate subassembly. It should be understood that this example is illustrative, and therefore should not be construed as being limiting in any way.

Based on the foregoing, it can be appreciated that an armored plate assembly has been disclosed herein. Although the subject matter presented herein has been described with respect to various structural features and/or methodological and transformative acts for forming the armored plate assembly and/or the various features thereof, it is to be understood that the concepts and technologies disclosed herein are not necessarily limited to the specific features or acts described herein. Rather, the specific features and acts are disclosed as example forms of implementing the concepts and technologies disclosed herein.

The subject matter described above is provided by way of illustration only and should not be construed as limiting. Various modifications and changes may be made to the subject matter described herein without following the example embodiments and applications illustrated and described, and without departing from the true spirit and scope of the embodiments of the concepts and technologies disclosed herein.

The invention claimed is:

1. An armored plate assembly comprising:

a base plate;

a gap layer located adjacent to the base plate, the gap layer having outer edges;

a containment structure having inner edges, wherein the inner edges are located adjacent to the outer edges; and a coating of polyurea that encompasses an assembly formed by assembling together the base plate, the gap layer, and the containment structure.

2. The armored plate assembly of claim 1, wherein the base plate comprises a steel plate.

3. The armored plate assembly of claim 1, wherein the gap layer comprises a layer of natural cork material.

4. The armored plate assembly of claim 1, wherein the containment structure comprises a piece of rubber.

5. The armored plate assembly of claim 1, wherein the base plate comprises a ceramic plate.

6. The armored plate assembly of claim 1, further comprising a secondary plate located adjacent to the gap layer.

7. The armored plate assembly of claim 6, wherein the secondary plate comprises a layer of KEVLAR® brand material.

8. The armored plate assembly of claim 1, wherein the base plate comprises a steel plate, wherein the gap layer comprises a layer of natural cork, and wherein the containment structure comprises a nitrile rubber gasket that surrounds the gap layer.

9. An armored plate assembly comprising:

a base plate;

a gap layer attached to the base plate by an adhesive, the gap layer having outer edges;

a containment structure having inner edges, the inner edges being located adjacent to the outer edges; and a coating of polyurea that encompasses an assembly formed by assembling together the base plate, the gap layer, and the containment structure.

10. The armored plate assembly of claim 9, wherein the base plate comprises a steel plate.

11. The armored plate assembly of claim 9, further comprising a secondary plate located between the gap layer and the coating of polyurea, wherein the secondary plate comprises a layer of KEVLAR® brand material.

12. The armored plate assembly of claim 9, wherein the gap layer comprises a layer of natural cork.

13. The armored plate assembly of claim 9, wherein the base plate comprises a ceramic plate.

14. The armored plate assembly of claim 9, wherein the coating of polyurea comprises polyurea having a thickness of less than one quarter of an inch.

15. The armored plate assembly of claim 9, wherein the gap layer comprises an air chamber.

16. The armored plate assembly of claim 11, wherein the gap layer comprises an air chamber formed by one or more spacers between the base plate and the secondary plate.

17. An armored plate assembly comprising:

a base plate that is formed from steel;

a gap layer attached to the base plate by an adhesive, the gap layer having outer edges, wherein the gap layer is formed from natural cork;

a containment structure having inner edges, wherein the inner edges are located adjacent to the outer edges, and wherein the containment structure is formed from a polymer; and a coating of polyurea that encompasses an assembly formed by assembling together the base plate, the gap layer, and the containment structure.

18. The armored plate assembly of claim 17, wherein the coating of polyurea has a thickness of less than one quarter of an inch.

19. The armored plate assembly of claim 17, wherein the containment structure is formed from nitrile rubber.

20. The armored plate assembly of claim 17, wherein the containment structure is configured to prevent spall from penetrating from within the coating of polyurea to outside of the coating of polyurea.

* * * * *